US009637836B2

(12) United States Patent
Papapanayiotou et al.

(10) Patent No.: US 9,637,836 B2
(45) Date of Patent: May 2, 2017

(54) ELECTROCHEMICAL DEPOSITION APPARATUS AND METHODS FOR CONTROLLING THE CHEMISTRY THEREIN

(71) Applicant: TEL NEXX, Inc., Billerica, MA (US)

(72) Inventors: Demetrius Papapanayiotou, Westford, MA (US); Arthur Keigler, Wellesley, MA (US); Jonathan Hander, Westford, MA (US); Johannes Chiu, Bedford, MA (US); David G. Guarnaccia, Carlisle, MA (US); Daniel L. Goodman, Lexington, MA (US)

(73) Assignee: TEL NEXX, INC., Billerica, MA (US)

( * ) Notice: Subject to any disclaimer, the term of this patent is extended or adjusted under 35 U.S.C. 154(b) by 101 days.

(21) Appl. No.: 14/321,053

(22) Filed: Jul. 1, 2014

(65) Prior Publication Data

US 2015/0008119 A1 Jan. 8, 2015

Related U.S. Application Data

(60) Provisional application No. 61/842,801, filed on Jul. 3, 2013.

(51) Int. Cl.
*C25B 15/00* (2006.01)
*C25B 15/08* (2006.01)
(Continued)

(52) U.S. Cl.
CPC ..... *C25D 21/14* (2013.01); *C25D 7/12* (2013.01); *C25D 17/00* (2013.01); *C25D 17/001* (2013.01); *C25D 17/002* (2013.01); *C25D 21/18* (2013.01)

(58) Field of Classification Search
CPC C25B 15/08; C25B 15/02; C25B 9/08; C25B 9/18; C25B 15/00; C25B 9/00;
(Continued)

(56) References Cited

U.S. PATENT DOCUMENTS 6,436,272 B1 8/2002 Brown et al.
6,503,375 B1 1/2003 Maydan et al.
(Continued)

FOREIGN PATENT DOCUMENTS

TW I222166 B 10/2004

OTHER PUBLICATIONS

International Search Report and Written Opinion mailed Oct. 30, 2014 in PCT/US2014/045037 (12 pages).
(Continued)

*Primary Examiner* — Zulmariam Mendez
(74) *Attorney, Agent, or Firm* — Rothwell, Figg, Ernst & Manbeck, P.C.

(57) ABSTRACT

An electrochemical deposition system is described. The electrochemical deposition system includes one or more electrochemical deposition modules arranged on a common platform for depositing one or more metals on a substrate, and a chemical management system coupled to the one or more electrochemical deposition modules. The chemical management system is configured to supply at least one of the one or more electrochemical deposition modules with one or more metal constituents for depositing the one or more metals. The chemical management system can include at least one metal enrichment cell and at least one metal-concentrate generator cell.

14 Claims, 12 Drawing Sheets

(51) Int. Cl.

| | |
|---|---|
| ***C25B 9/08*** | (2006.01) |
| ***C25B 9/00*** | (2006.01) |
| ***C25B 9/18*** | (2006.01) |
| ***C25D 5/08*** | (2006.01) |
| ***C25D 13/24*** | (2006.01) |
| ***C25D 21/14*** | (2006.01) |
| ***C25C 7/06*** | (2006.01) |
| ***C25D 7/12*** | (2006.01) |
| ***C25D 21/18*** | (2006.01) |
| ***C25D 17/00*** | (2006.01) |

(58) Field of Classification Search

CPC ..... C25D 17/001; C25D 5/08; C25D 17/00; C25D 17/02; C25D 13/24; C25D 21/14; C25C 7/06

USPC ..... 204/232, 242, 480, 626; 205/351, 392

See application file for complete search history.

(56) References Cited

U.S. PATENT DOCUMENTS

2003/0015417 A1* 1/2003 Fulton ..... C25D 21/14 204/228.6
2004/0256221 A1* 12/2004 Mishima ..... C25D 21/14 204/237
2007/0089990 A1* 4/2007 Behnke ..... C25D 21/14 205/81
2011/0220511 A1 9/2011 Dadvand et al.
2012/0298502 A1 11/2012 Papapanayiotou et al.
2012/0298504 A1 11/2012 Guarnaccia et al.
2013/0087463 A1* 4/2013 Schroiff ..... C25D 7/12 205/82
2013/0095649 A1 4/2013 Cheng et al.

OTHER PUBLICATIONS

International Preliminary Report and Written Opinion mailed Jan. 5, 2016 in PCT/US2014/045037 (7 pages).

Notification of Examination Opinions mailed Feb. 22, 2016 in corresponding Taiwan Patent Application No. 103122899 (with an English translation) (15 pages).

Notification of Examination Opinions mailed Sep. 22, 2016 in corresponding Taiwan Patent Application No. 103122899 (13 pages).

Office Action mailed Nov. 10, 2016 in corresponding Korean Patent Application No. 10-2016-7002965 (with an English translation) (13 pages).

Office Action mailed Dec. 22, 2016 in corresponding Chinese Patent Application No. 201480038155.2 (with an English translation) (15 pages).

* cited by examiner

ELECTROCHEMICAL DEPOSITION APPARATUS AND METHODS FOR CONTROLLING THE CHEMISTRY THEREIN

CROSS-REFERENCE TO RELATED APPLICATIONS

Pursuant to 37 C.F.R. §1.78(a)(4), this application claims the benefit of and priority to U.S. Provisional Application No. 61/842,801, filed on Jul. 3, 2013, which is expressly incorporated by reference herein in its entirety.

FIELD OF INVENTION

Embodiments disclosed herein relate generally to electrochemical deposition (ECD) and metal plating.

BACKGROUND OF THE INVENTION

Reliable multilevel interconnect formation and metallization is paramount to the success of next generation ultra large scale integration (ULSI) devices and advanced packaging, including three-dimensional integration (3DI) of electronic devices and both tight-pitch solder bump and micro-bump technology. As an example, dual damascene copper (Cu) interconnect formed in high aspect ratio via, contacts, and lines is envisioned for extension to the 7 nm (nanometer) technology node for ULSI fabrication and beyond. Additionally, for example, metallized, through silicon via (TSV) structures with a diameter of 1 to 30 microns and a depth of 10 to 250 microns enable 3DI electronic devices, while mask patterned deposition of lead-free solder at tight pitch bumping, i.e., pitch less than 300 microns, or micro-bumping is contemplated for advanced packaging.

To enable the above technology, electroplating or electrochemical deposition (ECD), among other processes, is used as a manufacturing technique for the application of various materials, including metals such as tin (Sn), silver (Ag), Sn—Ag alloy, nickel (Ni), copper (Cu), or otherwise, to various structures and surfaces, such as semiconductor workpieces or substrates. An important feature of systems used for such processes is an ability to produce uniform and repeatable material properties, e.g., thickness, composition, mechanical or electrical characteristics, etc.

SUMMARY OF THE INVENTION

Electrochemical deposition systems may use a primary electrolyte that includes constituent(s), e.g., metal ion, requiring replenishment upon depletion during plating. By way of example, in tin-silver applications, liquid replenishment of a tin salt solution may be required upon depletion. Such replenishment may be expensive and may depend substantially on the application. Moreover, replenishment may require significant down time of the electrochemical deposition tool or sub module for service and process re-qualification, which can adversely affect the cost of ownership of the deposition equipment. Accordingly, there is a desire for new and improved methods and apparatus for replenishment of depleted process electrolyte in electrochemical deposition tools.

Embodiments of the invention relate to a method and apparatus for electrochemical deposition (ECD) and electrolyte replenishment. According to one embodiment, an electrochemical deposition system is described. The electrochemical deposition system includes one or more electrochemical deposition modules arranged on a common platform for depositing one or more metals on a substrate, and a chemical management system coupled to the one or more electrochemical deposition modules. The chemical management system is configured to supply at least one of the one or more electrochemical deposition modules with one or more metal constituents for depositing the one or more metals. The chemical management system can include at least one metal enrichment cell and at least one metal-concentrate generator cell.

Additionally, although each of the different features, techniques, configurations, etc. herein may be discussed in different places of this disclosure, it is intended that each of the concepts can be executed independently of each other or in combination with each other. Accordingly, the present invention can be embodied and viewed in many different ways.

Note that this summary section does not specify every embodiment and/or incrementally novel aspect of the present disclosure or claimed invention. Instead, this summary only provides a preliminary discussion of different embodiments and corresponding points of novelty over conventional techniques. For additional details and/or possible perspectives of the invention and embodiments, the reader is directed to the Detailed Description section and corresponding figures of the present disclosure as further discussed below.

BRIEF DESCRIPTION OF THE DRAWINGS

A more complete appreciation of various embodiments of the invention and many of the attendant advantages thereof will become readily apparent with reference to the following detailed description considered in conjunction with the accompanying drawings. The drawings are not necessarily to scale, with emphasis instead being placed upon illustrating the features, principles and concepts. In the accompanying drawing.

DETAILED DESCRIPTION OF SEVERAL EMBODIMENTS

Figure 1:
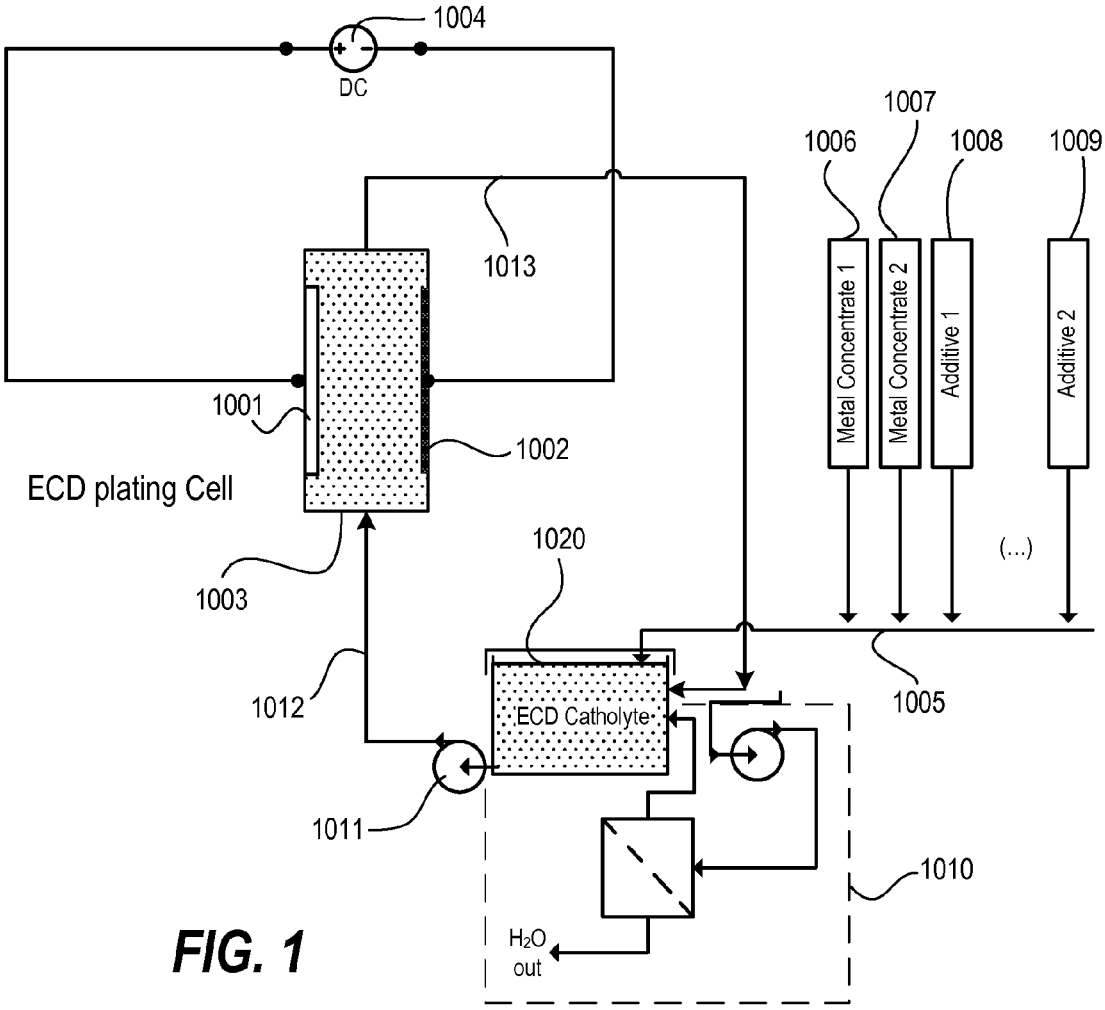
FIG. 1 is a simplified schematic of a plating cell showing a dosing scheme according to an embodiment.

Methods and apparatus for electrochemical deposition including replenishment of electrolyte are described in various embodiments. One skilled in the relevant art will recognize that the various embodiments may be practiced without one or more of the specific details, or with other replacement and/or additional methods, materials, or components. In other instances, well-known structures, materials, or operations are not shown or described in detail to avoid obscuring aspects of various embodiments of the invention. Similarly, for purposes of explanation, specific numbers, materials, and configurations are set forth in order to provide a thorough understanding of the invention. Nevertheless, the invention may be practiced without specific details. Furthermore, it is understood that the various embodiments shown in the figures are illustrative representations and are not necessarily drawn to scale.

Reference throughout this specification to "one embodiment" or "an embodiment" means that a particular feature, structure, material, or characteristic described in connection with the embodiment is included in at least one embodiment of the invention, but do not denote that they are present in every embodiment. Thus, the appearances of the phrases "in one embodiment" or "in an embodiment" in various places throughout this specification are not necessarily referring to the same embodiment of the invention. Furthermore, the particular features, structures, materials, or characteristics may be combined in any suitable manner in one or more embodiments. Various additional layers and/or structures may be included and/or described features may be omitted in other embodiments.

"Substrate" as used herein generically refers to the object being processed in accordance with the invention. The substrate may include any material portion or structure of a device, particularly a semiconductor or other electronics device, and may, for example, be a base substrate structure, such as a semiconductor wafer or a layer on or overlying a base substrate structure such as a thin film. Thus, substrate is not intended to be limited to any particular base structure, underlying layer or overlying layer, patterned or unpatterned, but rather, is contemplated to include any such layer or base structure, and any combination of layers and/or base structures. The description below may reference particular types of substrates, but this is for illustrative purposes only and not limitation.

As described in part above, various embodiments are disclosed for plating a substrate or structure on or within the substrate with metal using, for example, electrochemical deposition (ECD). During electrochemical deposition, metals such as tin (Sn), silver (Ag), nickel (Ni), copper (Cu), and alloys thereof (e.g., SnAg alloy) are plated onto exposed surfaces of the substrate in a plating cell by introducing metal ion(s) and reducing the dissolved metal ion(s) using electric current at the exposed surfaces to form a metal film. As noted above, an important feature of a robust plating cell is its ability to produce uniform and repeatable material properties. Electrochemical deposition systems, however, consume metal ions during plating, and thus require replenishment of depleted metal ion(s) in the process electrolyte for uniform and repeatable results.

Disclosed herein are numerous embodiments for plating cells and replenishment cells used in an ECD system. With respect to replenishment cells, some embodiments relate to concentrate generator cells, wherein an on-platform or off-platform metal concentrate generator cell is used to generate metal-containing electrolyte at a concentrated state (i.e., metal ion concentration greater than typical metal ion concentration used for processing) that may be stored and used to dose a plating cell during operation. Other embodiments relate to enrichment cells, wherein an on-board or off-board metal enrichment cell enriches an electrolyte circulating there through between an electrolyte reservoir and a plating cell.

Turning now to the figures, FIG. 1 is a simplified schematic of a plating cell showing a dosing scheme according to an embodiment. The plating cell may be used to perform electrochemical deposition (ECD) of a metal that is replenished with metal dosing from various metal sources. As an example, the plating cell may include a single compartment plating cell, i.e., a common electrolyte contacts the plating cell anode and cathode. The anode in the single compartment plating cell may be a soluble anode or an insoluble anode, preferably an insoluble anode. Some of the dosing components may be replaced with control modules, such as those described in various embodiments disclosed herein.

In FIG. 1, plating solution is contained in cell 1003 and reservoir 1020, and can be recirculated, via conduits 1012 and 1013 using pump 1011. The plating solution is replenished via dosing with solutions shown in the dosing array 1006-1009, and delivered via conduit 1005. The single compartment ECD cell includes wafer 1002 (functioning as the cathode). By way of a non-limiting example, wafer 1002 can be plated with SnAg alloy. Anode 1001, opposite wafer 1002, can be an inert anode. Dosed species can include some or all of the following: Sn-concentrate solution, Ag-concentrate solution, one or more organic additives, an Ag complexor concentrate, acid, and water. Electrical current through the ECD plating cell can be controlled via the power supply 1004.

Figure 5:
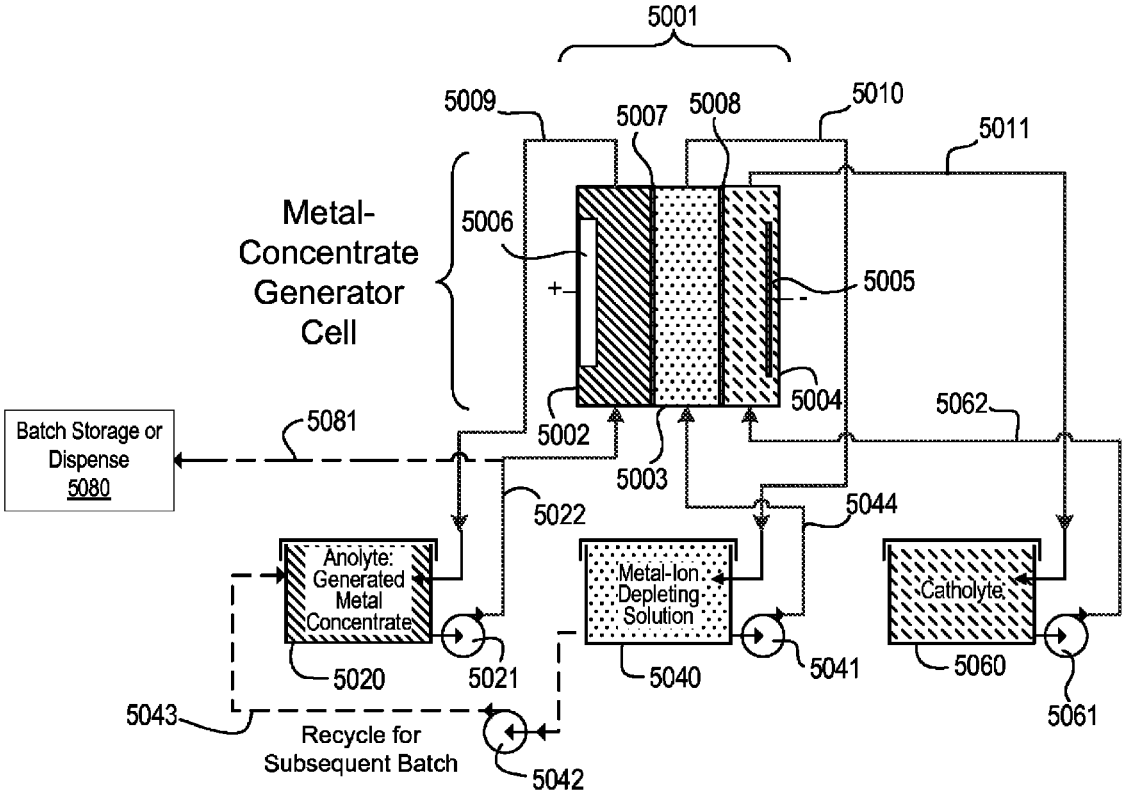
FIG. 5 shows a simplified schematic flow diagram of a metal-concentrate generator cell according to an embodiment.

In the case of SnAg, where Metal Concentrate 1 (1006) shown in FIG. 1 is Sn Concentrate, solution 1006 can be supplied via conduit 5081 or reservoir 5080 as metal concentrate product of FIG. 5. Similarly, in the same example, feed 1007 in FIG. 1 can be replaced with provision for using a Ag replenishment cell from FIG. 7 in-line with conduit 1013. FIG. 1 shows an optional water extraction module 1010 that can be based on the membrane distillation module disclosed in FIG. 9.

Figure 2A:
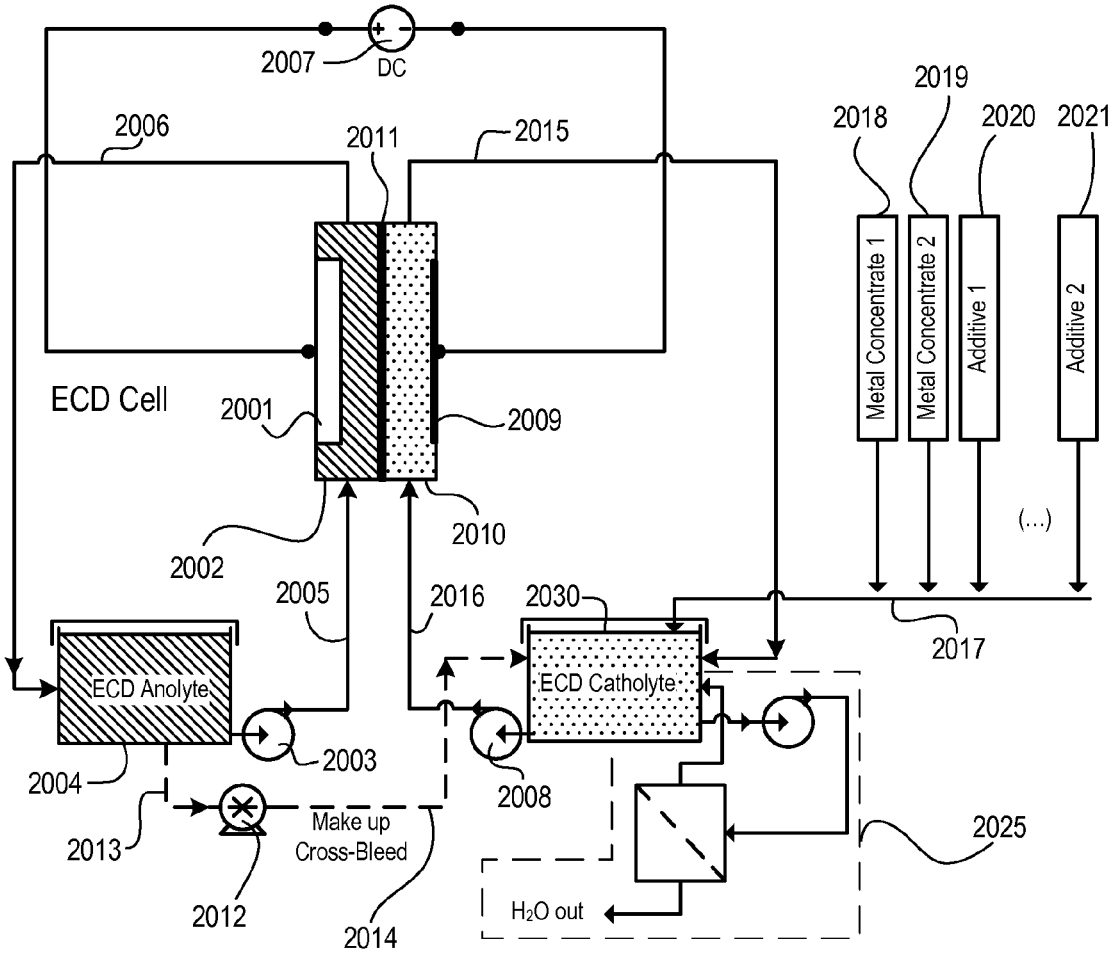
FIGS. 2A and 2B are simplified schematics of a plating cell showing a dosing scheme according to other embodiments.
Figure 2B:
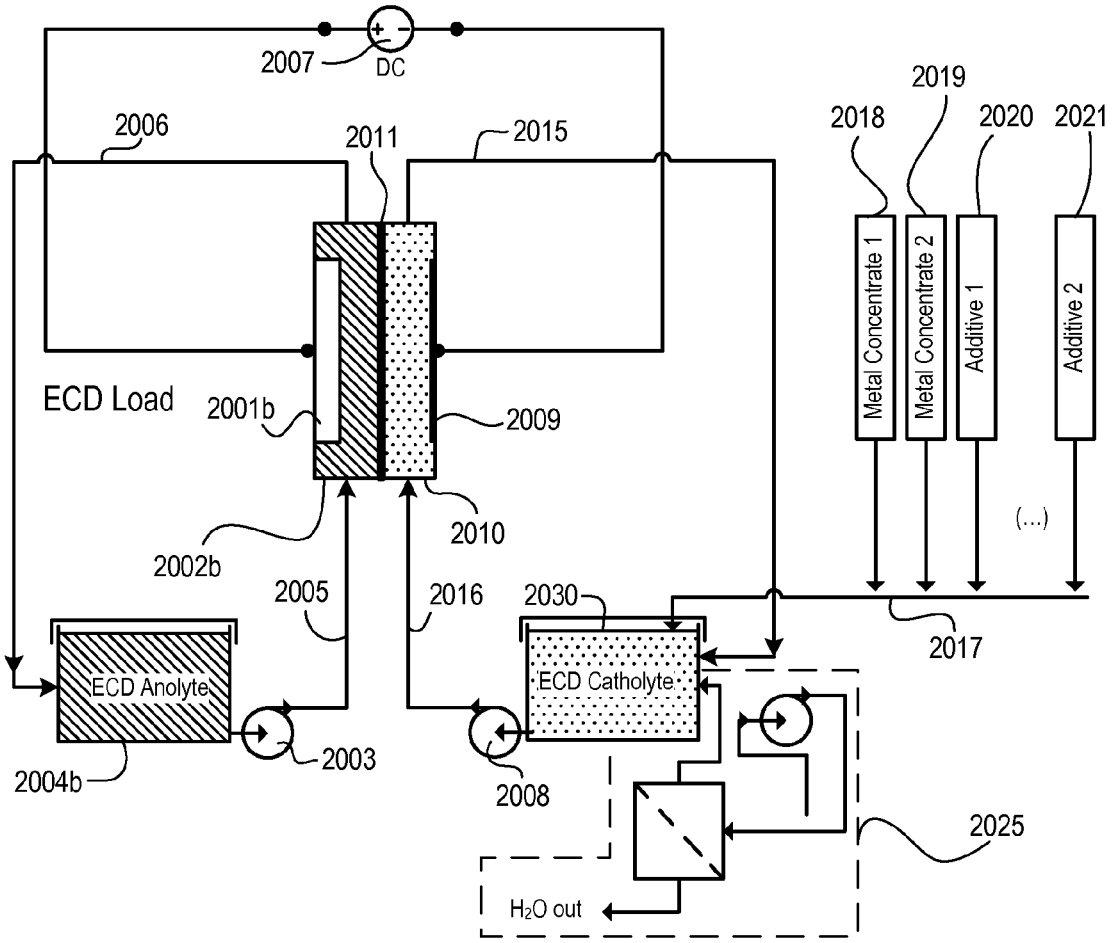

FIGS. 2A and 2B are simplified schematics of a plating cell showing a dosing scheme according to other embodiments. The plating cell may be used to perform electrochemical deposition (ECD) of a metal that is replenished with metal dosing from various metal sources. As an example, the plating cell may include a dual-compartment plating cell, i.e., anolyte and catholyte are separated within the plating cell by a membrane (ion exchange membrane of either cationic or anionic type). The anode in the dual-compartment plating cell may be a soluble anode or an insoluble anode, preferably a soluble anode. Note that some of the dosing components may be replaced with control modules, such as those described in various embodiments disclosed herein.

FIG. 2A is a simplified schematic of a dual-compartment ECD cell showing a dosing scheme. Note that some of the dosing components may be replaced with control modules, such as those described in the present disclosure. In this embodiment, the anode 2001 undergoes electro-dissolution as metal is deposited onto the wafer 2009, which acts as a cathode. Electro-dissolution of the anode 2001 occurs into the anolyte within compartment 2002. In some embodiments, depending on a particular plating application (whether, Cu, SnAg, Ni, or other metal), a transfer efficiency of metal ions across membrane 2011 may not be 100%. The incomplete transfer efficiency can result in an accumulation of metal ions on the anolyte side of the ECD cell (compartment 2002 and reservoir 2004 in FIG. 2A). This accumulation can be mitigated by cross-bleeding the anolyte from reservoir 2004 into the plating solution in reservoir 2030 from time to time. This can be accomplished via conduit 2013, valve 2012 and conduit 2014. In some configurations, even this cross-bleed may be insufficient to maintain the primary metal ion in the plating solution in reservoir 2030 and compartment 2010 at target levels. In such cases, supplementary dosing via conduit 2017 from dosing unit 2018 (containing Metal Concentrate 1) may be executed. Additional dosing units 2019, 2020, and 2021 can supply other metal concentrates and/or additives. A given anolyte solution can be recirculated, via conduits 2005 and 2006, through the ECD cell using pump 2003.

FIG. 2B shows an embodiment in which the dual-compartment ECD cell is equipped with an insoluble anode 2001*b*. In some instances, the configuration in FIG. 2B can be used for the same wafer plating applications as that in FIG. 2A. For example, both the embodiments in FIGS. 2A and 2B may be used for SnAg plating. Both embodiments have advantages in common over the configuration of FIG. 1. Although both embodiments are similar, the differing choice of anode between FIGS. 2A and 2B results in different benefits. By way of a particular example, in some implementations (notably the plating of Sn or Sn-containing alloys) the anolytes (in reservoir 2004 and compartment 2002, or in reservoir 2004*b*, and compartment 2002*b*) can be selected so as to have differing compositions. By ways of a specific example, anolyte in reservoir 2004 receives metal ions upon electro-dissolution of anode 2001, and may also use a cross-bleed to ensure that all dissolved metal ions cross-over to the plating solution in reservoir 2030. Dosing unit 2018 is then used for supplemental dosing. A given plating solution can be recirculated, via conduits 2016 and 2015, through the ECD cell using pump 2008.

In contrast, the cell depicted in FIG. 2B, equipped with inert anode 2001*b*, does not need to rely on the anolyte in compartment 2002*b* as a metal ion source. The cell in FIG. 2B may operate similarly to that in FIG. 1 in that the entire primary metal ion supply can be delivered through dosing unit 2018. For the cell in FIG. 2B, the anolyte may be comprised, in some embodiments, of a simple acid-water solution. In particular embodiments, control of such an anolyte can be accomplished by maintaining a targeted acid concentration. In some embodiments, acid control may be realized by an overflow weir and water dosing mechanism (not shown). Current through the ECD cell or ECD Load can be controlled via the power supply 2007.

In some embodiments (including but not limited to Sn for Sn or SnAg plating), a primary source of the supplementary (or main) metal ion concentrate from dosing unit 2018 (available pre-made from chemical suppliers) may be substituted by concentrate generated on-site using a module such as that described in FIG. 5. Similarly, conduit 2015 or 2016 can be modified to include a direct metal dissolution cell such as that described in FIG. 7.

FIGS. 2A and 2B also show the use of a water extraction module 2025. Optionally the module described in FIG. 9 may be used, or a simple evaporation module can also be used. A selection of a water extraction mechanism can be based on specifications of a given overall process (such as described for FIG. 9).

Figure 3A:
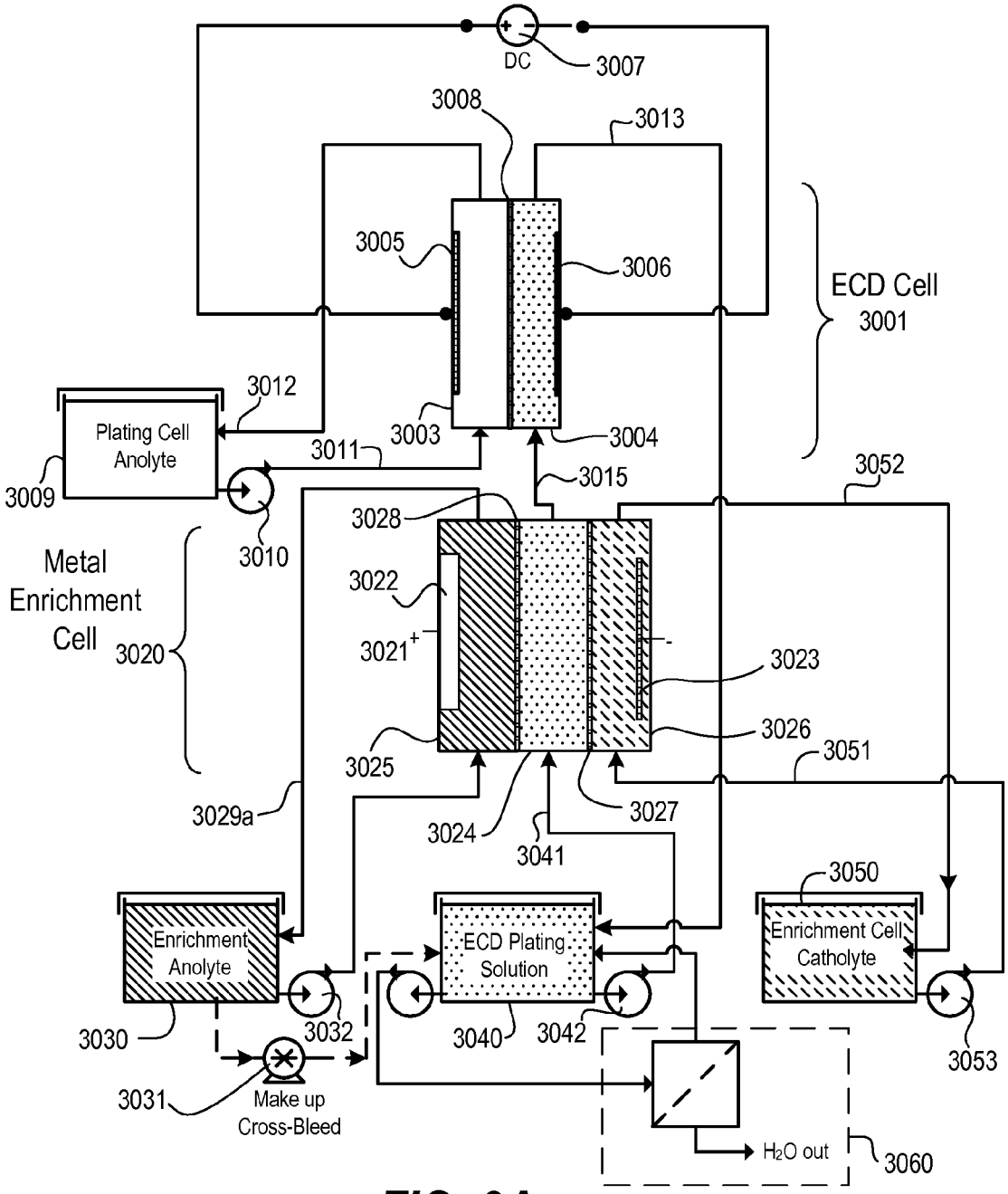
FIGS. 3A and 3B are simplified schematics of a plating cell operable with a metal enrichment cell according to yet other embodiments.
Figure 3B:
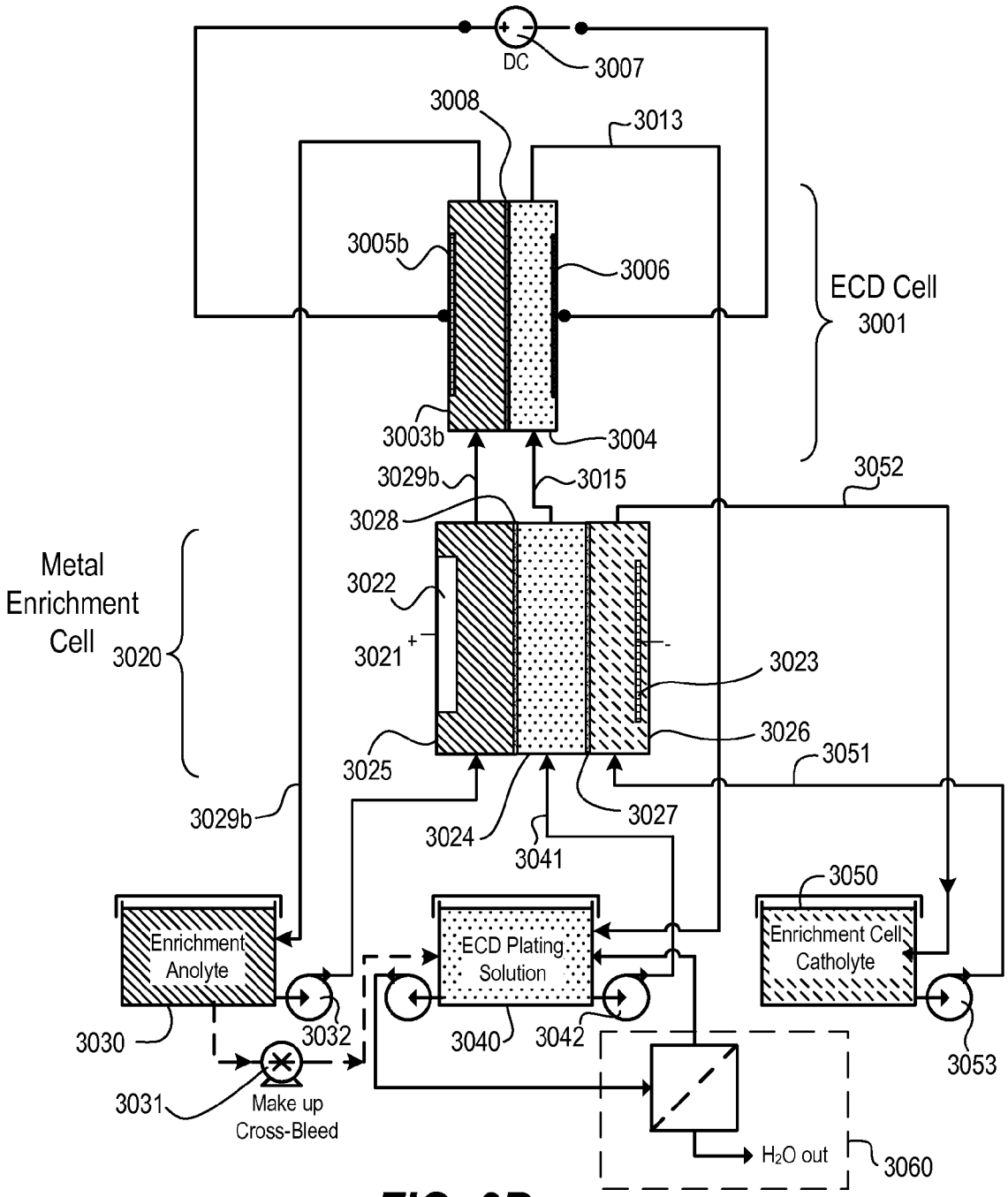

FIGS. 3A and 3B are simplified schematics of a plating cell operable with a metal enrichment cell according to yet other embodiments. The plating cell may be used to perform electrochemical deposition (ECD) of a metal that is replenished at least in part with metal dosing from a metal enrichment cell. As an example, the plating cell may include a dual-compartment plating cell, i.e., anolyte and catholyte are separated within the plating cell by a membrane. The anode in the single compartment plating cell may be a soluble anode or an insoluble anode, preferably an insoluble anode.

Figure 7:
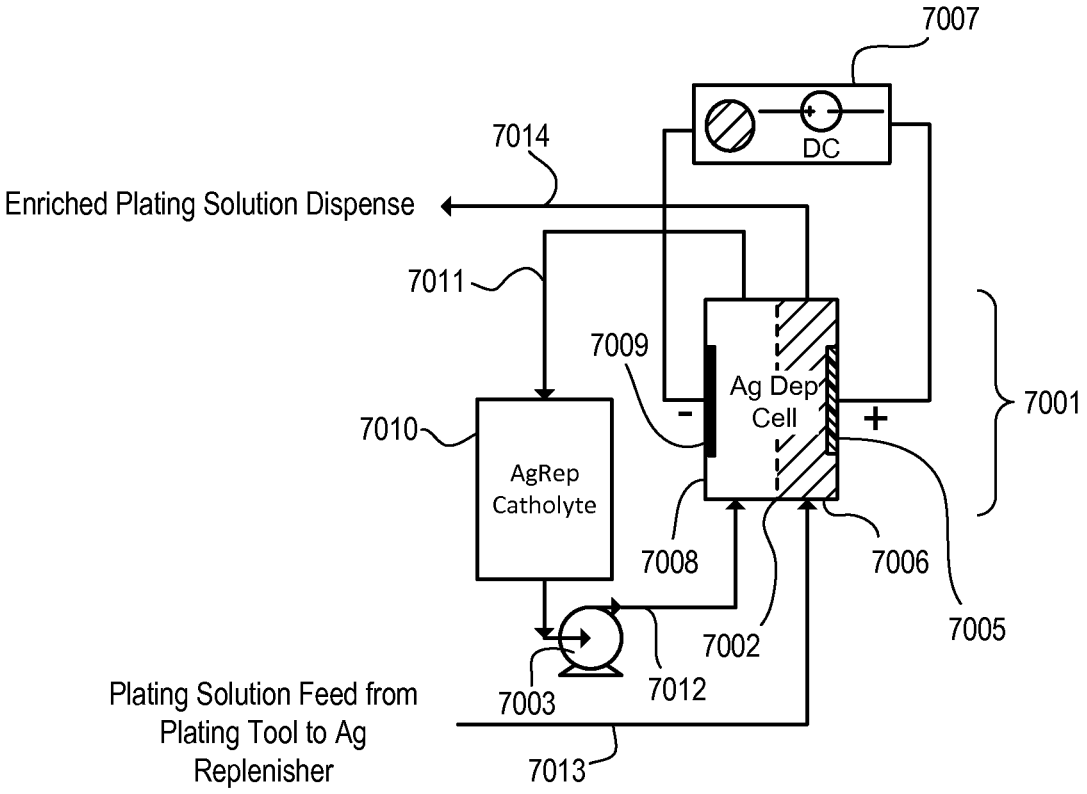
FIG. 7 shows a simplified schematic flow diagram of a metal enrichment cell according to an embodiment.

FIGS. 3A and 3B depict different implementations of a metal enrichment cell that includes through-membrane metal replenishment, as described in FIG. 7. Note that example embodiments are not limited to those depicted in these drawings, but it should be understood that other configurations can be made.

FIGS. 3A and 3B are a simplified schematic of two-compartment ECD cell equipped with an insoluble anode that operates in conjunction with a three-compartment, through-membrane metal replenishment cell. Either configuration in FIG. 3A or 3B may be used for many applications. For instance, in an embodiment where the metal being plated is Sn, or a Sn-containing alloy, the metal enrichment cell 3020 in FIG. 3B may be used as a booster module for further enriching the anolyte in reservoir 3030 through electro-dissolution of anode 3022 beyond the ability of anode 3005*b* (which is limited to total currents consumed at the actual wafer work piece 3006). The embodiment shown in FIG. 3A, on the other hand, relies on the metal enrichment cell 3020 to supply the entire dissolved metal requirement. Also, while not shown, metal enrichment cell 3020, or a combination of metal enrichment cells, may be configured to support multiple ECD cells 3001, or to support more chemically complex plating solutions.

Note that in FIGS. 3A and 3B, many of the components are similar to previously described components in related figures. For example, conduits 3011, 3012, 3029*a*, 3029*b*, 3041, 3015, 3013, 3051, and 3052 can circulate or recirculate the various respective solutions via corresponding pumps 3010, 3032, 3042, and 3053. Compartments 3003, 3003*b*, 3004, 3024, 3025, and 3026 share respective solutions with corresponding reservoirs 3009, 3030, 3040, and 3050. Ion exchange membranes 3008, 3028, and 3027 function to separate corresponding compartments. Current through the ECD cell 3001 can be controlled via the power supply 3007 and anode 3005/3005*b*. Current through the metal enrichment cell 3020 can be controlled via the power supply 3021 across anode 3022 and cathode 3023. Cross-bleeding can be accomplished using cross-bleed pump 3031. Water extraction module 3060 can be used to remove excess water.

Different configurations of these modules can be used for various embodiments, and can also be combined with various ECD modules and with each other to enable optimal chemistry control strategies for a number of scenarios. Additional description of an ECD module, including plating cell componentry such as fluid agitation, substrate support, substrate sealing, substrate electrical contact, anode design, cathode design, etc., the cross-bleed approach can be found in U.S. Patent Application Publication Number 2012/0298504 published on Nov. 29, 2012 entitled "Electro Chemical Deposition and Replenishment Apparatus," which is incorporated herein by reference.

Figure 4:
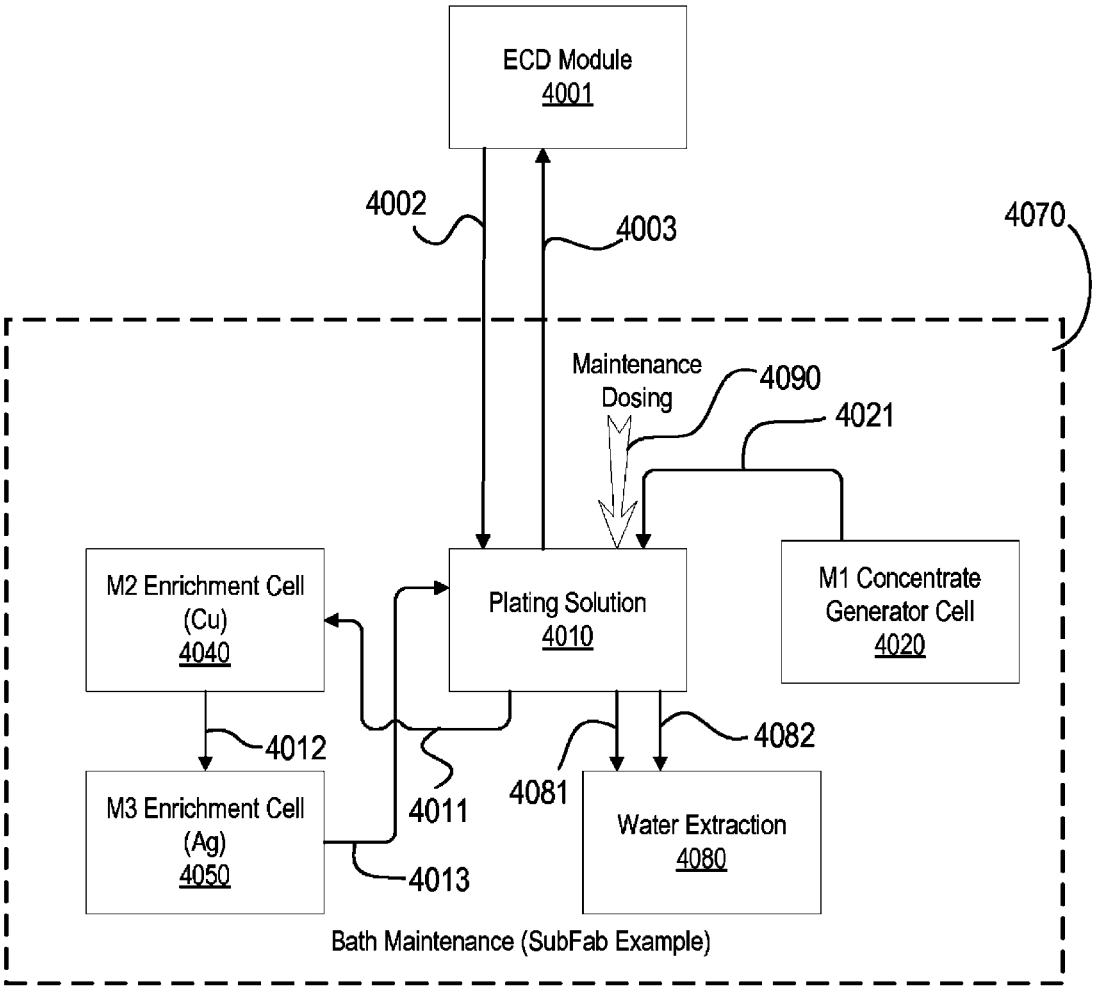
FIG. 4 is a simplified schematic of an electrochemical deposition module and a chemical management system according to an embodiment.

Another embodiment is to use an integrated system for plating cell management in one or more ECD modules. FIG. 4 is a simplified block diagram of an electrochemical deposition module and a chemical management system supporting the plating cell(s) of the ECD module for plating metals, including metal alloys and tertiary metal alloys (e.g., SnCuAg). FIG. 4 illustrates an exemplary embodiment that consolidates much of the preceding description using a chemical management system to control metal alloy plating, such as SnCuAg alloy, as an example of how the various components and schemes outlined in the disclosure of various embodiments may be combined to provide a bath management solution. The case of CuSnAg has been chosen as an exemplary case since it involves three (3) metallic components, but an implementation such as that shown in FIG. 4 is not limited to that case.

FIG. 4 shows an embodiment in which one or more ECD modules 4001 operate in a wafer fabrication facility. Although a single ECD module is shown in FIG. 4, note that two or more ECD modules may be used. For plating of device wafers, the one or more ECD modules 4001 typically reside in the cleanroom of a wafer-fabrication facility (fab). In some embodiments, valuable cleanroom space may be saved by locating many of the chemical control and support functions in a sub-fab below the one or more ECD modules 4001. FIG. 4 depicts a schematic of such an example system.

In FIG. 4, an electrochemical deposition system is illustrated that includes one or more electrochemical deposition modules 4001 arranged on a common platform for depositing one or more metals on a substrate. The electrochemical deposition system further includes a chemical management system 4070 coupled to the one or more electrochemical deposition modules 4001, and configured to supply at least one of the one or more electrochemical deposition modules 4001 with one or more metal constituents (M1, M2, M3) for depositing the one or more metals. The chemical management system 4070 can be located on the common platform proximate to the electrochemical deposition modules 4001. The common platform can be located on a fab floor with the chemical management system 4070 located on a sub-fab floor. The common platform can include a wet area that includes one or more electrochemical deposition modules and a dry area coupled to the wet area. This common platform can be configured to receive one or more substrates from a fab environment and transfer the one or more substrates into and out of the wet area.

The chemical management system 4070 includes at least one metal enrichment cell 4040, 4050 (M2, M3) that replenishes at least one of the one or more metal constituents and supplies the replenished metal constituent to at least one of the one or more electrochemical deposition modules 4001 in a synchronous manner with depositing the one or more metals on the substrate, and at least one metal-concentrate generator cell 4020 (M1) that generates a concentrated solution of at least one of the one or more metal constituents and doses at least one of the one or more electrochemical deposition modules with the concentrated metal constituent in an asynchronous manner with depositing the one or more metals on the substrate. In other embodiments, dosing the electrochemical deposition modules with the concentrated metal constituent can be executed in a synchronous matter. In one embodiment, at least one metal-concentrate generator cell generates concentrated solution at a metal concentration that exceeds about 100 g/l. In another embodiment, metal enrichment cell replenishes at least one of the one or more metal constituents at a metal concentration that is less than about 100 g/l.

The chemical management system 4070 in FIG. 4 includes multiple modules that can supply solutions from a sub-fab to the ECD module 4001 via conduits 4002, 4003, and/or others. In one example, Sn may be supplied by dosing via conduit 4021 with concentrate generated in one or more parallel generator cells 4020 (as disclosed in FIG. 5). Maintenance dosing 4090 into plating solution compartment 4010 can optionally be used. The plating solution may be enhanced with Cu via (e.g., a through-membrane) metal enrichment cell 4040 (see FIG. 7 and description). Module 4050 may further be included to enhance Ag (see FIG. 7). Water may be removed in water extraction module 4080, optionally via a configuration as described in FIG. 9. Provisions for auxiliary dosing (4090) of additives and water may also be provided. Additional conduits 4011, 4012, 4013, 4081, and 4082 for circulating and delivering various solutions may further yet be provided.

In one embodiment, at least one metal-concentrate generator cell defines an anode region, a cathode region, and a metal-ion capture region disposed between the anode region and the cathode region. The metal concentrate generator cell includes a soluble anode disposed in the anode region, an inert cathode disposed in the cathode region, a first ion exchange membrane disposed between the anode region and the metal-ion capture region, and a second ion exchange membrane disposed between the cathode region and the metal-ion capture region. A power source is electrically coupled to the soluble anode and the inert cathode and is configured to generate metal-ions from the soluble anode when electrical current flows between the soluble anode and the inert cathode. An anolyte reservoir and first pump can be included that circulate the anolyte through the anode region of the metal-concentrate generator cell. A metal-concentrate dispensing system configured to supply doses of the metal-concentrate to at least one of the one or more electrochemical deposition modules. In some embodiments, the metal-concentrate dispensing system can be coupled to an output of the first pump via a first valve.

In another embodiment, at least one metal enrichment cell comprises an anode region and a cathode region. The metal enrichment cell includes a soluble anode disposed in the anode region, an inert cathode disposed in the cathode region, and at least one ion exchange membrane disposed between the anode region and the cathode region. A power source is electrically coupled to the soluble anode and the inert cathode and is configured to generate metal-ions from the soluble anode when electrical current flows between the soluble anode and the inert cathode. A catholyte reservoir and first pump are configured to circulate the catholyte through the cathode region of the metal enrichment cell. A metal enrichment circulation line and a second pump are arranged to circulate a metal depleted process electrolyte from a process region of at least one of the one or more electrochemical deposition modules through the anode region of the metal enrichment cell, and supply a process electrolyte enriched by metal from the soluble anode to the process region of the at least one of the one or more electrochemical deposition modules.

In another embodiment, at least one metal enrichment cell comprises an anode region, a cathode region, and a plating solution enrichment region disposed between the anode region and the cathode region. The metal enrichment cell include a soluble anode disposed in the anode region, an inert cathode disposed in the cathode region, a first ion exchange membrane disposed between the anode region and the plating solution enrichment region, and a second ion exchange membrane disposed between the cathode region and the plating solution enrichment region. A power source is electrically coupled to the soluble anode and the inert cathode to generate metal-ions from the soluble anode when electrical current flows between the soluble anode and the inert cathode. An anolyte reservoir and first pump are configured to circulate the anolyte through the anode region of the metal enrichment cell. A catholyte reservoir and second pump are configured to circulate the catholyte through the cathode region of the metal enrichment cell. A metal enrichment circulation line and a third pump are arranged to circulate a metal-depleted process electrolyte from a process region of at least one of the one or more electrochemical deposition modules through the plating solution enrichment region of the metal enrichment cell, and supply a process electrolyte enriched by metal from the soluble anode to the process region of the at least one of the one or more electrochemical deposition modules. The metal enrichment cell can comprises four chambers in some embodiments. A more detailed description of the cells will be described below.

As noted previously, there can be various configurations and embodiments. This can include various selections of metals, anodes, ion exchange membranes, and metal sources. Selection of type of anodes, materials, additives, and membranes can depend on a particular plating application specified for a given substrate. For example, different materials may be used when performing Cu plating as compared to SnAg plating.

As described above, techniques for electrochemical deposition can include a primary ECD unit/module, and one or more cells that can generate various chemicals, such as metal ions, to assist, replenish, enrich, etc., with the plating process. There can be various configurations among the different modules. Such modules assist with plating bath controls and provide a set of components that can be combined in various ways depending on specifications of a particular plating application or treatment process.

The replenishment component for providing a source of metal ion, for example, may include a metal-concentrate generator cell. FIG. 5 shows a simplified schematic flow diagram of a metal-concentrate generator cell and associated components according to an embodiment.

Referring to FIG. 5, a metal-concentrate generator cell 5001 is illustrated that may be used to replenish electrolyte constituent for a plating system (not shown). Metal-concentrate generator cell 5001 can be a sub-system of a main cell or larger chemical processing system.

In one configuration, the metal-concentrate generator cell 5001 can be divided into three process compartments (5002, 5003, and 5004) via membranes 5007 and 5008. Membranes 5007 and 5008 may include cationic or anionic ion exchange membranes. The three process compartments (5002, 5003, and 5004) define an anolyte region within an anolyte compartment 5002, a catholyte region within a catholyte compartment 5004, and a metal-ion capture region within a metal-ion capture compartment 5003 disposed between the anolyte region and the catholyte region. The metal concentrate generator cell 5001 includes a metal anode 5006 disposed in the anolyte region, an inert cathode 5005 disposed in the catholyte region, a first membrane 5007 disposed between the anolyte region and the metal-ion capture region, and a second membrane 5008 disposed between the catholyte region and the metal-ion capture region.

Metal anode 5006, which can be a soluble anode, is located within anolyte compartment 5002. Metal anode 5006 dissolves under the application of a controlled current by an external power source (not shown, (+)ve connection). The power source is electrically coupled to the metal anode 5006 and the inert cathode 5005, and facilitates the generation of metal-ions form the metal anode 5006, if soluble, when electrical current flows between the metal anode 5006 and the inert cathode 5005. Furthermore, this power application results in metal ions dissolving metal anode 5006, when soluble, into an anolyte solution in anolyte compartment 5002.

Anolyte compartment 5002 can be separated from the rest of the cell 5001 via membrane 5007. In one embodiment, membrane 5007 is selected of a material that reduces transport or that substantially inhibits or blocks passage of metal ions from the anolyte region in the anolyte compartment 5002 to the metal-ion capture region in the metal-ion capture compartment 5003. Metal-ion capture compartment 5003 can contain a metal-ion depleting (MID) solution. Metal-ion depleting solution is a pre-concentration solution, that is, a solution used to capture metal ions that pass through membrane 5007. Metal-ion depleting solution can also be stored, or transferred, to reservoir 5040, which enables accumulation of dissolved metal ions from anolyte compartment 5002. This also enables the anolyte metal ion concentration to increase to yield a particular specified metal concentration.

Additionally, the metal-concentrate generator cell 5001 is coupled to an anolyte reservoir 5020 and first pump 5021 that circulates the anolyte through supply line 5022 to the anolyte region of the metal-concentrate generator cell 5001, and through return line 5009 back to the anolyte reservoir 5020. Additionally yet, the metal-concentrate generator cell 5001 includes a metal-concentrate storage or dispensing system 5080 coupled to an output of the first pump 5021 via a first valve, and arranged to supply doses of the metal-concentrate to one or more electrochemical deposition modules.

The metal-concentrate storage or dispensing system 5080 can include a metal-concentrate storage reservoir, and a dosing system that controllably meters introduction of metal-concentrate from the metal-concentrate storage reservoir to the one or more electrochemical deposition modules. For example, the dispensing system may include a dosing system that controllably meters introduction of metal-concentrate from the anolyte reservoir 5020 to the one or more electrochemical deposition modules by opening and closing the first valve.

Furthermore, the metal-concentrate generator cell 5001 includes a metal-ion capture reservoir 5040 and a second pump 5041 that circulates a metal-ion capture solution through a supply line 5044 to the metal-ion capture region, and through a return line 5010 to the metal-ion capture reservoir 5040. And, further yet, the metal-concentrate generator cell 5001 includes a catholyte reservoir 5060 and a third pump 5061 that circulates the catholyte through a supply line 5062 to the catholyte region and through a return line 5011 to the catholyte reservoir 5060.

Further yet, the metal-concentrate generator cell 5001 includes a recycle line 5043 coupling the metal-ion capture reservoir 5040 to the anolyte reservoir 5020, and a fourth pump 5021 for transferring at least part of the metal-ion capture solution from the metal-ion capture reservoir 5040 to the anolyte reservoir 5020.

Periodically, the metal-ion capture solution can be transferred to the anolyte reservoir 5020 when, for example, a metal-ion concentration exceeds a threshold, and the metal-ion capture solution can be replaced with new solution having reduced metal-ion concentration or having substantially no metal-ion concentration. The metal-concentrate generator cell 5001 can include a monitoring system coupled to the anolyte reservoir and arranged to measure metal-ion concentration in an anolyte solution. Additionally, a monitoring system can be coupled to the metal-ion capture reservoir and arranged to measure a metal-ion concentration in the metal-ion capture solution. And, further, the metal-concentrate generator cell 5001 can include a chemical control system coupled to the fourth pump 5042, and programmed to transfer at least part of the metal-ion capture solution from the metal-ion capture reservoir 5040 to the metal-concentrate reservoir when a metal-ion concentration of the metal-ion capture solution is at or exceeds a threshold value. When preparing Sn concentrate, the threshold value may be about 30 g/l.

Metal-concentrate generator cell 5001 can be operated in either continuous mode (synchronous to ECD plating) or batch mode (asynchronous). In either mode, metal-concentrate generator cell 5001 can dispense a metal-concentrate product via conduit 5081, of a particular specification, to a given target such as a storage system or ECD system. Metal-concentrate product can be dispensed on demand via a dosing system feeding an ECD module (any conventional ECD module). Alternatively, metal-concentrate product can be dispensed as an entire batch that can be stored (in reservoir 5080) for later use on a given dosing/feeding system supplying of an ECD tool. Note that dosing can be synchronous or asynchronous.

Figure 6A:
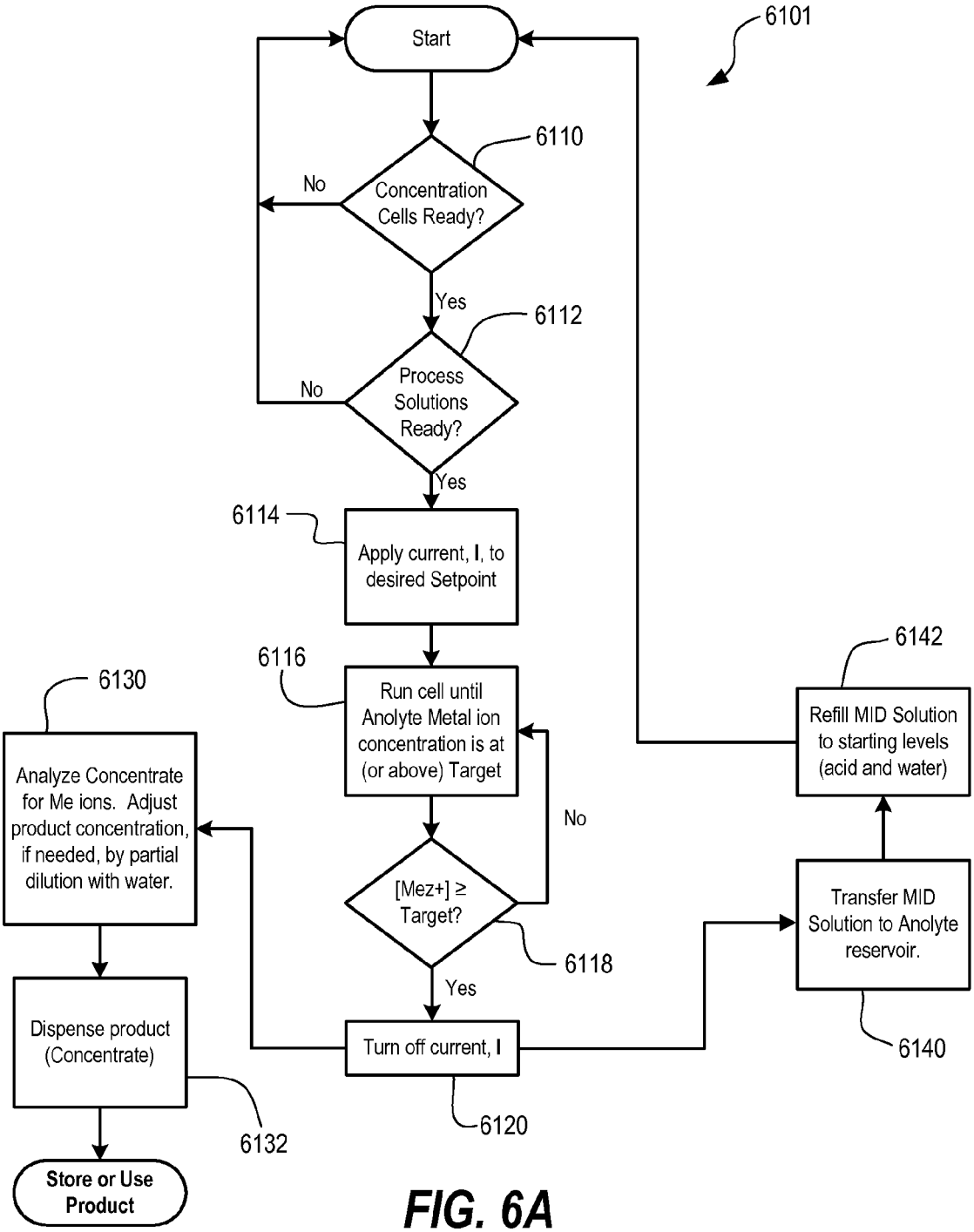
FIG. 6A is a flow chart illustrating a method of operating a metal concentrate generator according to an embodiment.
Figure 6B:
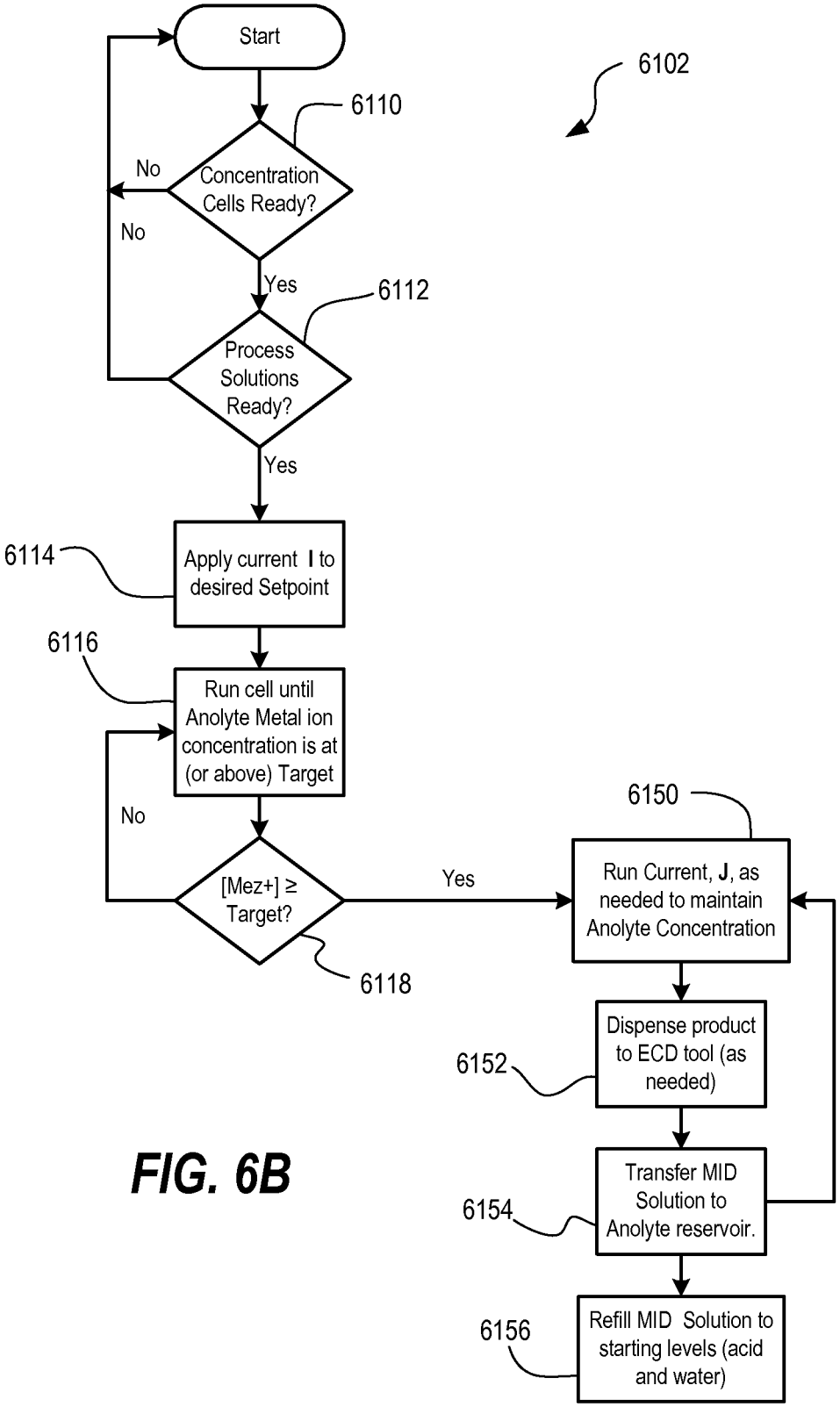
FIG. 6B is a flow chart illustrating a method of operating a metal concentrate generator according to another embodiment.

FIGS. 6A and 6B show simplified operational flow charts for either batch or continuous modes of the system in FIG. 5. Note that continuous mode operation can have a batch-like phase during initial or post-maintenance start-up.

The metal anode 5006 can have a composition selected from various soluble metals or alloys. For example, metal anode 5006 can comprise Sn (tin) (various alpha-particle grades), Pb (lead) (various alpha particle grades), SnPb, Cu (copper), Ni (nickel), Ag (silver), Bi (bismuth), etc. A selection of solution chemistry in anolyte compartment 5002 and reservoir 5020 depends on a particular application and metal. For example, in one embodiment having Sn, the initial anolyte solution can predominantly comprise methanesulfonic acid (MSA) and water, which can optionally include one or more antioxidant species. A selection of supporting acid species and concentrations depends on cell behavior and desired or specified product composition. Other compatible chemistries can include, but are not limited to, aqueous sulfuric acid or MSA for Cu, and sulfuric acid+boric acid for Ni.

The solutions in all three cell compartments (5002, 5003, and 5004) are distinct and each can serve a specific purpose. To provide for capacity, adequate mixing, and efficient mass transfer within a cell, each solution in the cell 5001 can be contained in bulk in respective reservoirs (5020, 5040, and 5060) and is recirculated from a respective bulk reservoir through the cell 5001 via corresponding pumps 5021, 5041, and 5061. Conduits 5009, 5010, 5022, 5044, and 5062 can be used to transport the various solutions between respective reservoirs, compartments, and systems. Additional provisions (not shown) can be made to each reservoir to allow filling charging chemicals (acid, water, or additives, as appropriate), withdrawing samples for analysis, and controlling atmosphere via purging with selected gases (for example, $N_2$, Ar, air, etc.).

In some embodiments, a metal-ion depleting solution (stored in 5003 and 5040) provides beneficial results. The metal-ion depleting solution serves two related purposes. One purpose is to protect cathode 5005 positioned within catholyte compartment 5004. In practice, materials used for membrane 5007 are unable to block 100% of metal ions from migrating out of the anolyte compartment 5002 during electrolysis, especially as the product metal ion concentration increases and the H+ concentration decreases. Having the metal-ion depleting solution in the metal-ion capture compartment 5003 protects the cathode 5005 from undesirable metal deposition. If undesirable deposition happens, then fixing the cathode deposition can involve interruption of the unit's operation to remove the cathode 5005 for cleaning or replacement. Having metal-ion depleting solution within metal-ion capture compartment 5003 prevents the metal-ion depleting solution achieving levels of metal and acid that would allow membrane 5008 to lose its ability to effectively block metal ion transport. For example, with Sn concentrate generation, operating conditions are chosen so that the Sn concentration in the metal-ion depleting solution never exceeds 30 g/L, and preferably never exceeds 20 g/L. Another purpose of the metal-ion depleting solution is to increase concentration of the anolyte solution. The metal-ion depleting solution can be recycled into the anolyte solution (via pump 5042 and line 5043) either in batch or continuous mode, thus allowing full capture of all dissolved metal ions into the metal-concentrate product, which is the final product of the metal-concentrate generator cell 5001. Note that pumping of metal-ion capture compartment can be optional.

The catholyte solution (in catholyte compartment 5004 and reservoir 5060) can be comprised of water and a predetermined electrolyte. It is beneficial to use a same acid as used in the anolyte and metal-ion depleting solution. The purpose of the catholyte solution is to provide a current path through the cell and, in some cases, to act as a source or sink of supplemental ions, as needed by the overall system. Depending on the process details (metal, acid combination), control of the catholyte solution may require monitoring of acid concentration and periodic adjustments via suitable dosing and make-up ports (not shown). Such control can be realized in a batch mode or in continuing increments. The cathode 5005 should be able to support the cathodic counter-reaction that serves to complete the current within the cell 5001. In a preferred embodiment, the cathode reaction consists of the reduction of hydrogen ions to produce hydrogen gas. The evolving gas bubbles are transported back to the catholyte reservoir (5060). Pumping of catholyte reservoir can be optional. A mechanism (not shown) can be used in the catholyte compartment 5004 or reservoir 5060 to exhaust the evolved hydrogen gas.

Membranes 5007 and 5008 can be chosen from a number of conventionally available membranes. Membrane selection can depend on the metal types and concentrations that are desired in the metal-concentrate product. By way of a non-limiting example, when using Sn-MSA concentrate, both membranes can be chosen from a number of available anionic membranes. Anionic membrane sources for this configuration, and for other configurations in related examples, include, but are not limited to, those in the Neosepta™ line from Astom Co., those in the Fumasep series from FuMA-Tech GmbH, and those in the Selemion™ line from Asahi Glass.

A purity of the resulting solution is determined by purity of the raw materials. Alpha-particle emission of the metal in metal-concentrate product (solution) is determined by the alpha emission properties of the dissolving anode 5006. In cases where alpha particle emission can cause device degradation, so called "super-ultra-low alpha", SULA, anodes can be selected for use. These types of anodes are available from a number of vendors and for a variety of metals.

Referring now to FIGS. 6A and 6B, methods for generating a metal-concentrate are disclosed as flow charts 6101 and 6102 in various embodiments. Flow charts 6101 and 6102 begin at step 6110 with preparing metal-concentrate generator cell(s) and verifying that they are ready for operation. Step 6110 can include providing a metal-concentrate generator cell that defines an anolyte region, a catholyte region, and a metal-ion capture region disposed between the anolyte region and the catholyte region. This metal concentrate generator cell can include a soluble anode disposed in the anolyte region, an inert cathode disposed in the catholyte region, a first ion exchange membrane disposed between the anolyte region and the metal-ion capture region, and a second ion exchange membrane disposed between the catholyte region and the metal-ion capture region. One embodiment can include providing a first anionic membrane between the anolyte region and the metal-ion capture region, and a second anionic membrane between the catholyte region and the metal-ion capture region.

Once process solutions are ready in step 6112, the anolyte is circulated (recirculated) between an anolyte reservoir and the anolyte region of the metal-concentrate generator cell using a first pump. After a target concentration for metal-ions in the anolyte is set, a metal-concentrate is produced in step 6114 by applying an electrical current through the metal-concentrate generator cell between the soluble anode and the inert cathode and generating metal ions in the anolyte. In some embodiments, the anode can be selected from the group consisting of Sn, Pb, Cu, Ag, Ni, and Bi.

The metal-concentrate generator cell is run in step 6116 until the target concentration for metal-ions in the anolyte is reached or exceeded. Once the target concentration is reached or exceeded (step 6118) the electrical current to the metal-concentrate generator cell is terminated in step 6120.

Thereafter, at least a portion of the metal concentrate from the anolyte reservoir can be transferred to the metal-concentrate storage reservoir, wherein the metal concentrate can be analyzed and adjusted in step 6130, if needed, by partial dilution with a diluting agent, such as water. In step 6132, the metal-concentrate (or a diluted form of the metal-concentrate or a chemically modified derivative of the metal concentrate) can be dispensed or controllably metered when being introduced to a plating solution/cell or to one or more electrochemical deposition modules.

Additionally, during operation of the metal-ion concentrate generator cell, a metal-ion capture solution can be recirculated between a metal-ion capture reservoir and the metal-ion capture region of the metal-concentrate generator cell using a second pump. Also, a catholyte can be recirculated between a catholyte reservoir and the catholyte region of the metal-concentrate generator cell using a third pump.

As shown in FIG. 6A, following terminating current in step 6120, at least part of the metal-ion capture solution can be transferred from the metal-ion capture reservoir to the anolyte reservoir (step 6140) using a recycle line coupling the metal-ion capture reservoir to the anolyte reservoir and a fourth pump. Moreover, following metal-ion capture solution transfer, the metal-ion capture reservoir can be refilled (step 6142).

As shown in FIG. 6B, once the target concentration is achieved in step 6118, depleted metal-ions in the anolyte can be replenished by continuing or reapplying the electrical current as needed (step 6150) through the metal-concentrate generator cell to maintain the anolyte concentration at or near the target value, while controllably metering the introduction of the metal-concentrate from the anolyte reservoir to one or more electrochemical deposition modules in step 6152. Furthermore, at least part of the metal-ion capture solution can be transferred in 6154 from the metal-ion capture reservoir to the anolyte reservoir using a recycle line coupling the metal-ion capture reservoir to the anolyte reservoir and a fourth pump. Following metal-ion capture solution transfer, the metal-ion capture reservoir can optionally be refilled in step 6156.

FIG. 7 shows a simplified schematic flow diagram of a metal enrichment cell according to an embodiment. Using direct dissolution of metal into an electrolyte replenishment stream, one or more of the constituent metals in a plating solution can be enriched by direct electro-dissolution into the plating solution. One example is with silver in SnAg or SnCuAg plating baths. Since silver is somewhat more noble than most of the other metals in the plating solution (Sn or Cu), cationic Ag in the plating solution can easily reduce to metallic Ag unless stabilized by some means. Typically, this stabilization is accomplished by selecting complexing species to effectively hinder Ag reduction kinetics. For Ag, the complexing species are typically organic ligands with selectivity to Ag.

Also, in typical alloy plating applications, as Ag is depleted from the plating bath via alloy plating onto a work piece, Ag can be dosed into the plating bath via additions of a pre-made concentrate solution. Due to the relatively high levels of Ag in the dosing concentrate, relatively high levels of complexing species may also be required in the concentrate. Repeated dosing of Ag is, therefore, accompanied by repeated dosing of complexing species. As a result, while Ag levels (concentrations) in the plating solution are kept relatively constant, complexor concentrations continually increase with use unless otherwise mitigated by, for example, completing periodic (and expensive) bleeds.

High levels of organic species in the plating solutions are typically not desirable as these species may lead to defects such as void formation. Having an alternative Ag dosing scheme that does not result in the accumulation of complexing species is, therefore, desirable. FIG. 7 discloses one such alternative. Note that in FIG. 7, components for draining, dosing, or sampling the various solutions in question are not shown as these are conventionally known.

FIG. 7 is a simplified schematic of a direct-dissolution metal enrichment cell. The example of FIG. 7 uses Ag as the enriching metal. The metal-enriching subsystem of FIG. 7 can be added in-line to an existing plating system or tool. In this example, a silver depleted (Ag-depleted) plating solution is fed from a plating tool via conduit 7013 to a Ag replenisher to circulate through the enrichment cell 7001, then the plating solution is returned via conduit 7014 to the plating tool as an enriched plating solution.

In FIG. 7, a metal enrichment cell 7001 that defines an anode region within an anolyte chamber 7006 and a cathode region within a catholyte chamber 7008, where the metal enrichment cell 7001 includes a soluble anode 7005 disposed in the anode region, an inert cathode 7009 disposed in the cathode region, and at least one membrane 7002 disposed between the anode region and the cathode region. A power source 7007 is electrically coupled to the soluble anode and the inert cathode that generates metal-ions from the soluble anode when electrical current flows between the soluble anode 7005 and the inert cathode 7009.

Metal enrichment cell 7001 is embodied a two-compartment cell including the anolyte chamber 7006, the catholyte chamber 7008, and the membrane 7002 that separates the anolyte chamber 7006 from the catholyte chamber 7008. Membrane 7002 can be an ion exchange membrane that is either a cationic membrane or an anionic membrane. Other embodiments, however, may have additional chambers. The plating solution functions as an anolyte, wherein a metal enrichment circulation line 7013, 7014, and a second pump (not shown) are arranged to circulate a metal depleted process electrolyte from at least one process electrolyte reservoir through the anode region of the metal enrichment cell 7001, and supply a process electrolyte enriched by metal from the soluble anode 7005 to the at least one process electrolyte reservoir. The at least one process electrolyte reservoir includes a process region of at least one electrochemical deposition module.

Additionally, an aqueous acid solution, recirculated from reservoir 7010 using pump 7003 and flow conduits 7012 and 7011, can function as catholyte. In one embodiment, the catholyte and associated reservoir 7010 (catholyte reservoir) are dedicated to this sub-system. In an alternate embodiment, the catholyte can be a solution shared with the ECD-tool plating cell. In one embodiment, the catholyte is composed of an aqueous solution of the same acid as used in the plating solution. In another embodiment for SnAg plating, the catholyte is composed of an aqueous solution of methanesulfonic acid (MSA) in the range of 10-100 g/L MSA.

The metal enrichment cell 7001 can include an enriched process electrolyte dispensing system coupled to the process electrolyte reservoir, which is arranged to supply doses of enriched process electrolyte to one or more electrochemical deposition modules via conduit 7014. Furthermore, the metal enrichment cell 7001 can include a chemical control system coupled to the power source 7007, which is programmed to adjust an electrical property of the metal enrichment cell 7001 and controllably achieve a target metal concentration for the enriched process electrolyte.

The enrichment cell anode 7005 may consist of metal (e.g., Ag) provided in one of a number of forms (slab, disk, pellets, etc.). The anode 7005 may be chosen to conform to desired plating specifications, for example, ultra-low-alpha emitting metal anodes are available from a number of manufacturers. The anode 7005 can be in contact with the plating solution (which serves as anolyte). Because the metal (Ag) is relatively noble, no adverse displacement plating occurs. Current passes through the cell, controlled by power supply 7007, to dissolve $Ag^+$ into the plating solution in anolyte chamber 7006. An existing complexor species present in the plating solution, which are generally present in excess, allows the Ag to dissolve stably into the plating solution. Control of the total current and time of electrolysis (charge) through the cell, determines the amount of silver dispensed into the plating solution. The enrichment cell 7001/sub-system can be run either synchronously or asynchronously with plating in the ECD cell, allowing for both maintaining a given concentration of Ag in the plating solution and for dosing a depleted bath back to a specified $[Ag^+]$ concentration.

The membrane 7002 can be chosen from any of the previously specified family of anionic membranes. For better operation, the membrane 7002 includes excellent (90-100%) exclusion of metal ions, stability in the process chemistry, and excellent exclusion of complexing species.

Cathode 7009 is an inert, insoluble cathode and can be constructed of any of a number of suitable materials including, but not limited to, Pt-coated (clad, plated) metals such as Ti or Nb. Alternatively, graphitic or other inert materials may be used.

Another embodiment includes a method for metal enrichment of process solutions for replenishing a plating system. This method comprises providing a metal enrichment cell that defines an anode region and a cathode region. The metal enrichment cell includes a soluble anode disposed in the anode region, an inert cathode disposed in the cathode region, and at least one ion exchange membrane disposed between the anode region and the cathode region. Metal-ions are generated from the soluble anode by causing electrical current to flow between the soluble anode and the inert cathode using a power source electrically coupled to the soluble anode and the inert cathode. The catholyte is circulated through the catholyte region of the metal enrichment cell using a catholyte reservoir and first pump. A metal-depleted process electrolyte is circulated from at least one process electrolyte reservoir through the anode region of the metal enrichment cell using a metal enrichment circulation line and a second pump. A process electrolyte enriched by metal from the soluble anode is supplied to the at least one the process electrolyte reservoir using the metal enrichment circulation line and the second pump. Doses of enriched process electrolyte can be supplied to one or more electrochemical deposition modules using an enriched process electrolyte dispensing system coupled to the process electrolyte reservoir. Supplying the process electrolyte enriched by metal from the soluble anode to the at least one the process electrolyte reservoir can include supplying the process electrolyte to a process region of at least one electrochemical deposition module. A target metal concentration for the enriched process electrolyte can be controllably achieved by adjusting an electrical property of the metal enrichment cell using a chemical control system coupled to the power source.

Figure 8:
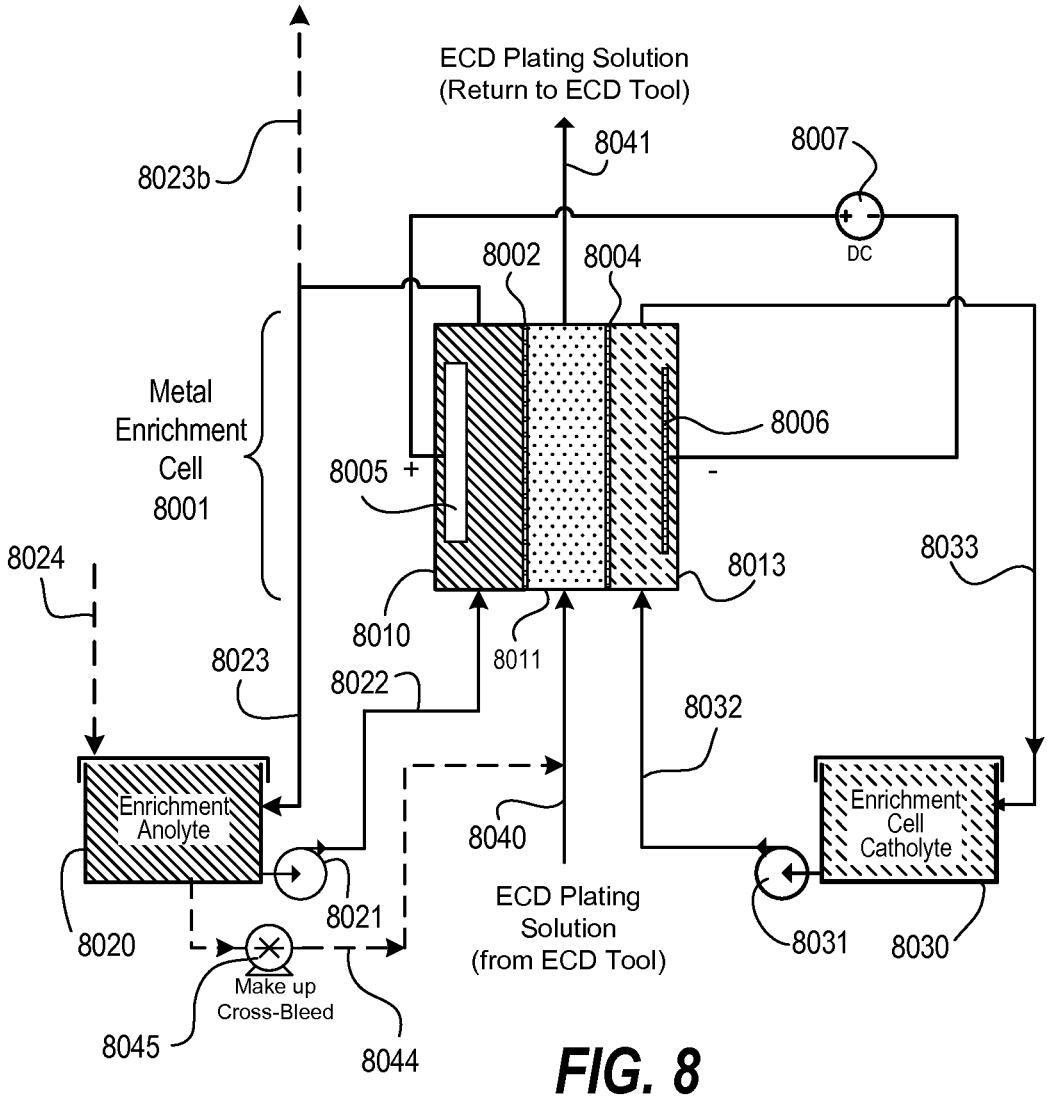
FIG. 8 shows a simplified schematic flow diagram of a metal enrichment cell according to another embodiment.

FIG. 8 shows a simplified schematic flow diagram of a metal enrichment cell according to another embodiment. Metal enrichment cell 8001 is a three-compartment unit in which primary enrichment of metal ions occur through a membrane. FIG. 8 is a simplified schematic of one embodiment of a metal-enriching sub-system that includes a three-compartment metal-enriching cell and associated hardware. In general, metal enrichment cell 8001 includes membrane 8002 and membrane 8004. Membranes 8002 and 8004 can be the same material or they may be different to each other. A given selection of each membrane can be based on specific processes executed by metal enrichment cell 8001.

An ECD plating solution is typically supplied from an ECD tool, such as by way of line 8040. The ECD plating solution can be circulated through middle compartment 8011 of cell 8001. The ECD plating solution then exits middle compartment 8011 and returns to the ECD tool (not shown) via line 8041. Alternatively, line 8041 can transport the ECD plating solution to a reservoir prior to re-supplying the ECD plating tool.

An anode 8005 (typically soluble) resides in the anolyte compartment 8010 of the cell 8001. Anode 8005 can be comprised of a metal (or metals) that correspond to a given replenishment solution. Metal selection can depend on a given application. Example metal selections for anode 8005 include Sn, Cu, Pb, Ni, PbSn, Bi, and so forth. Anode 8005 can have various physical configurations or shapes such as disk, slab, rods, pellets, etc. A given anolyte solution can be recirculated, via lines 8022 and 8023, through anode compartment 8010 using pump 8021. Reservoir 8020 contains the anolyte solution not contained within the compartment 8010 and the recirculating hardware. In some alternative embodiments (such as those shown in FIG. 3B), the anolyte solution can circulate through both the anolyte chamber 8010 and the anolyte compartment of supported ECD cell or cells (via conduit 8023*b*). In such a configuration, anolyte returns to the anolyte reservoir 8020 via conduit 8024.

A blanketing gas mechanism (not shown) can be optionally used to maintain a blanketing gas in reservoir 8020. An example where a blanketing gas might be required is $N_2$ gas to prevent oxidation of $Sn^{2+}$ ions in a Sn concentrate solution.

A transference number of a metal ion is defined as the proportion of the total current carried by the flux of that ion during electrolysis. When the transference number through membrane 8002 of a given desired metal is less than 100%, then periodic cross-bleeding of the anolyte from reservoir 8020 to the plating solution in line 8040 (or 8041, or its destination reservoir) can be executed. Such cross-bleeding may be realized through a dosing loop such as that shown comprising pump 8045 and conduit 8044. Additional description of the cross-bleed approach can be found in U.S. Patent Application Publication Number 2012/0298502 published on Nov. 29, 2012 entitled "Electro Chemical Deposition and Replenishment Apparatus," which is incorporated herein by reference.

The cathode 8006 serves as the counter electrode in the cell 8001 and is located in catholyte compartment 8013. Cathode 8006 can be inert and insoluble. Example materials for composition of the cathode 8006 include, but are not limited to, Pt (Platinum), Pt coated (clad, plated), Nb (Niobium), Ti (Titanium), conductive forms of carbon such as graphite, and combinations thereof. The function of cathode 8006 is to provide a terminus for electrical flow through the cell by sustaining a reduction reaction sufficient to reduce hydrogen ions to evolve hydrogen gas. The evolved gas circulates out of the catholyte compartment 8013 via the solution return conduit 8033. An exhaust mechanism (not shown) can be used to safely exhaust gas from reservoir 8030. Also not shown, reservoir 8030 may be configured with an inert gas blanket mechanism to supply blanketing gas such as nitrogen or argon.

In most embodiments, it may be preferable to constitute the catholyte solution (in catholyte compartment 8013 and reservoir 8030) from a same acid as used in the ECD plating solution. A given catholyte solution can be recirculated, via conduits 8032 and 8033, through cathode compartment 8013 using pump 8031. For example, in a Sn enrichment cell used to provide Sn to an MSA-based solution for SnAg plating, the catholyte can be an MSA solution. As another example, in embodiments in which the metal-enrichment cell 8001 is used in conjunction with sulfuric acid-based plating solutions (some Cu and Ni plating applications, for example), then the catholyte electrolyte can be sulfuric acid.

The ECD plating solution can be enriched in metal content via the current-driven transport of metal ions through membrane 8002 from the anolyte solution. There is corresponding ionic flow through membrane 8004. Membrane 8002 is selected such that the contribution of metal ion flux (i.e., the transference number) to the total current flowing through the membrane can be maximized. In some cases, it is possible to have approximately 100% of the current carried by metal ions. High metal-ion flux can be efficiently obtained using a cation-selective membrane. In applications in which a cationic membrane is used, membranes that provide a sufficiently high metal ion transference number can be acquired from DuPont, Inc. (Nafion line), from Astom Co (Neosepta™ line), or other suppliers. When metal ion transference numbers across membrane 8002 are significantly less than 99%, then excess metal ions that accumulate in the anolyte may be transferred to the ECD plating solution from time to time via the cross-bleed conduit 8044, in such a way that ensures that all chemical species remain within designated limits. An additional function of membrane 8002 is to prohibit loss of species such as Ag ions and desired organic additives from the ECD plating solution in middle compartment 8011 to the anolyte compartment 8010.

Membrane 8004 functions to limit exchange of material between the ECD plating solution in middle compartment 8011 and the catholyte solution in catholyte compartment 8013. Ideally, membrane 8004 supports current flow across the cell through transport of anions or hydrogen ions and prohibits exchange (and thus loss) of metal ions from the plating solution to the catholyte. In addition, membrane 8004 functions to prevent loss of organic additives from the ECD plating solution to the catholyte. Suitable membrane materials for construction of the membrane barrier 8004 include, but are not limited to, monovalent-selective cationic membranes, such as those available in the Neosepta line from Astom Co., anionic membranes, such as those in the Neosepta line, membranes the Fumasep series from FuMA-Tech GmbH, or membranes in the Selemion line from Asahi Glass.

Current through the metal enrichment cell 8001 can be controlled via the power supply 8007. Such control can be based on information about the current efficiencies associated with metal electrodissolution of the anode and transport across the membranes, which allows targeting of a metal enrichment rate to match depletion rates in the ECD plating tool.

In some embodiments, particularly when metal ion concentrations in the ECD plating solution are sufficiently high, suitable membrane materials for membrane 8004 may not be available such as to ensure 100% exclusion of metal ion transfer from plating solution to catholyte. As a result, an undesirable loss of metal ions from the ECD plating solution and deposition of metal onto cathode 8006 may result. Alternative embodiments can be used to address this issue. Alternatives have been outlined in, for example, U.S. Patent Application Publication Number 2012/0298502 published on Nov. 29, 2012.

One feature of these alternatives is to adapt a four-chamber cell, for example, inserting a Metal Ion Depleting solution similar to chamber 5003 disclosed in FIG. 5. The four chambers can be separated in such a configuration via a cationic membrane(s) between anolyte and plating solution, as described above for FIG. 8, and using two other membranes, which may be either anionic or monovalent-selective cationic membranes. Control of the metal ion concentration in chamber 1540, of U.S. Patent Application Publication Number 2012/0298502, can then be achieved either by the methods outlined in U.S. Patent Application Publication Number 2012/0298502 or via cross-bleeding solution from the reservoir 1542 to the anolyte from time to time, as needed. Process economics can be used to identify an optimal choice as well as details of specific process chemistry (i.e., SnAg vs. Cu vs. Ni, etc.).

Alternative embodiments can include mechanisms and sub-systems (not shown) for initial chemical charging of the reservoirs 8020 and 8030, maintenance dosing of chemical components such as acid, water, and additives, and components for sampling and draining the process streams.

Figure 9:
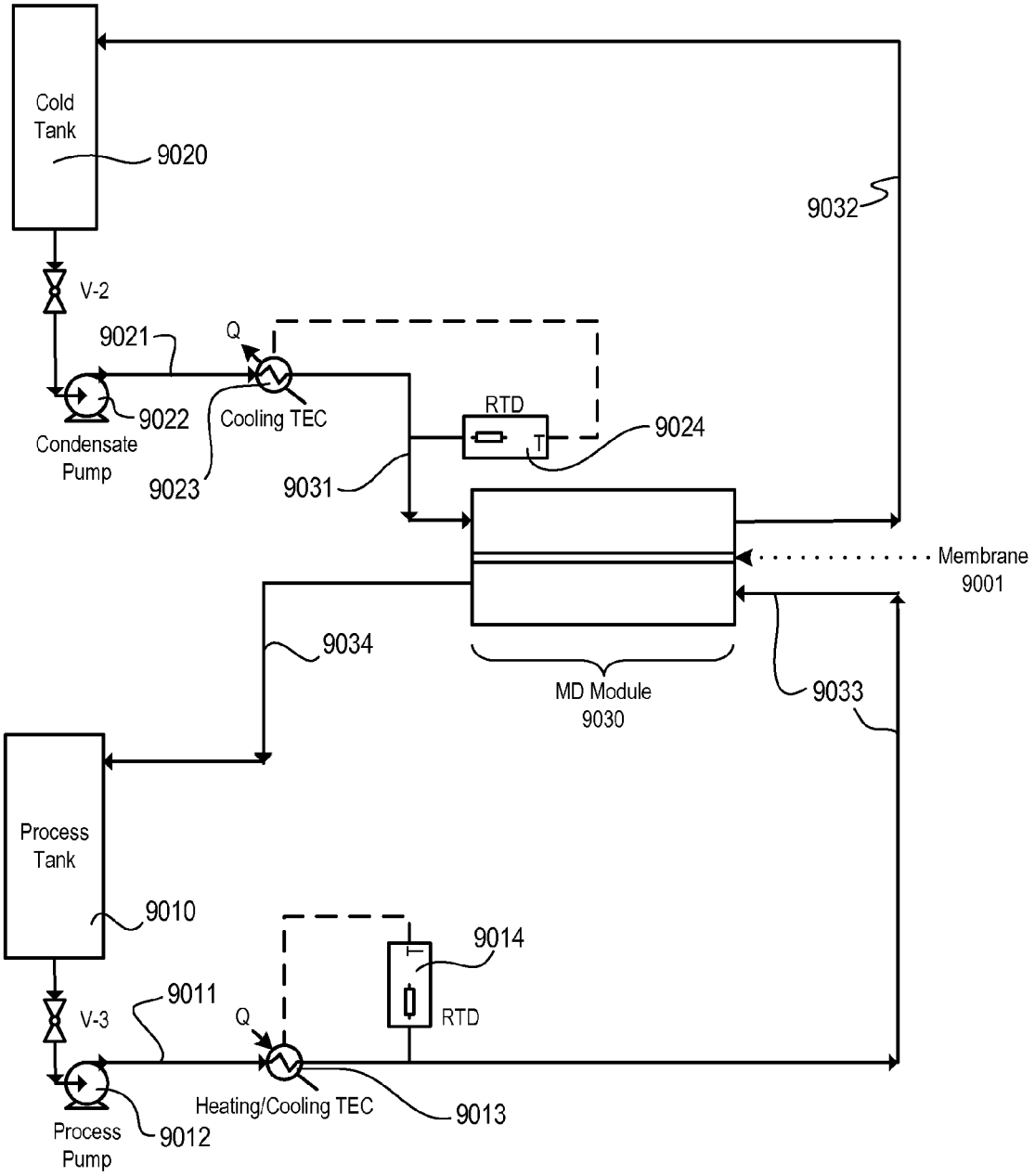
FIG. 9 is a simplified schematic of a water extraction module according to yet another embodiment.

According to yet another embodiment, FIG. 9 is a simplified schematic of a water extraction module. With a number of bath metal replenishment configurations herein, plating solution volume often increases as wafers are processed. This volume increase can be caused through the accumulation of direct doses of supplementing chemicals (additives, metal concentrates), and/or caused by water additions through electro-osmosis or drag-in. While the active species in the dosing concentrates become depleted, the net volume increase remains. Accordingly, mitigating this depletion can be advantageous. One route for mitigation is to bleed off a selected volume, but such bleeding off may result in the loss of valuable chemistry. Evaporation remains an alternate route of volume depletion, but the natural rate of evaporation for a given bath configuration on a given tool type may not be sufficient to achieve the optimal level of volume control and, thus augmenting natural evaporation can be beneficial.

One path to such evaporation-rate augmentation is a brute force approach in which a carrier gas, such as nitrogen or air, is heated and contacted with the plating solution to achieve a desired evaporation rate. The evaporation rate may be further enhanced using various contacting schemes to promote efficient gas-liquid contact. A direct-contact approach can be effective but has some potential drawbacks. One potential drawback occurs if there is a constraint on exhaust capabilities imposed by geometry of a particular tool, including the necessity to prevent inadvertent venting of process chemistry through the exhaust conduit. A different type of drawback occurs when the plating solution is sensitive to oxygen and requires (or would benefit from) inert gas ($N_2$) contact. In such cases, having a sufficient flow of $N_2$ may be costly.

FIG. 9 is a simplified schematic of a water extraction module including of a membrane distillation module and a minimum of associated components as disclosed herein. FIG. 9 shows a membrane distillation module operating on a "Process Tank," which can be an ECD plating solution reservoir. In this schematic, a membrane distillation (MD) module 9030 is positioned in-line with a plating solution reservoir 9010. Module 9030, also known as a contactor, can be equipped with a small-pore hydrophobic membrane 9001. The membrane 9001 can be configured in a number of form factors, examples of which include being configured as a flat sheet or a tube bundle in a shell-and-tube configuration. Since the transport rate (water extraction rate) is proportional to the available area, larger area-to-volume ratios are beneficial.

Membrane distillation works by using a vapor pressure driving force across a vapor-permeable but liquid-impermeable membrane. By contacting a low-vapor-pressure phase and a high-vapor-pressure phase on either side of a suitable membrane, vapor travels from the high-vapor-pressure side to the low-vapor-pressure side of the membrane, where it condenses. Specifically, in membrane distillation, the vapor pressure difference is controlled by controlling the temperatures of the distillate (hot) and condensate (cold) phase.

In the current embodiment, the distillate side is the ECD plating (or other process) solution, which can be contained in reservoir 9010. The condensate side is provided with liquid from a separate reservoir 9020. The process solution is fed through one side via conduit 9033 of module (contactor) 9030 and returns through the downstream side via conduit 9034, and can be recirculated, via conduit 9011 using pump 9012. On the other side of the membrane 9001, condensate solution circulates from reservoir 9020 (cold tank). Flow of the two streams through module 9030 is preferably counter-current, with cold-side solution entering via conduit 9031 on the opposite side of the process stream and returning through conduit 9032, and can be recirculated, via conduit 9021 using pump 9022. Heating and/or cooling devices 9013 and 9023 can be used to cool or heat the plating solution and the condensate solution. Sensors 9014 and 9024 can monitor the temperatures of the two solutions (distillate and condensate) to maintain a specified temperature difference across the membrane 9001.

In one embodiment of the configuration shown in FIG. 9, the condensate solution can be water. Using water has the benefit of simplicity but sets a lower limit on the cold side temperature to a few degrees above freezing (e.g., approximately 5 degrees C.).

Water extraction rates are most easily increased by heating the distillate side temperature (plating solution). In some embodiments the plating solution temperature can be increased, but in other embodiments an upper temperature limit may be fixed by limits imposed by the specifications of a particular ECD process and chemical stability. Embodiments provide beneficial transfer rates for a number of membrane choices even with plating solutions such as SnAg with [Sn]=80 g/L and [MSA]=130 g/L when the process temperature is set at 25 degrees Celsius and the condensate temperature is set at 10 degrees Celsius, even with the colligative water vapor suppression at these electrolyte concentrations.

Suitable membranes are available from Gore of Newark, Del., and Millipore, of Billerica, Mass. Prefabricated modules such as those provided by Membrana may also be used, depending on the process chemistry.

As noted, the configuration shown in FIG. 9 is a simplified schematic. It is understood that additional mechanisms and techniques (not shown) may be added to facilitate operation. These mechanisms can include conventional mechanisms such as drains, feeds, and level control for the condensate reservoir, mechanisms for flushing out the membrane module 9030, and so forth. In addition, the embodiment depicted in FIG. 9 can serve as a basis for a multi-module (contactor) configuration. Having two or more contactors, either in parallel or series, allows for higher total water extraction rates and for redundancy.

Different configurations of these modules can be used for various embodiments, and can also be combined with various ECD modules and with each other to enable optimal chemistry control strategies for a number of scenarios.

Although several embodiments of this invention have been described in detail above, those skilled in the art will readily appreciate that many modifications are available in the embodiments without materially departing from the novel teachings and advantages of techniques herein. Accordingly, all such modifications are intended to be included within the scope of this invention.

The invention claimed is:

1. An electrochemical deposition system, comprising:

one or more electrochemical deposition modules arranged on a common platform for depositing one or more metals on a substrate; and a chemical management system coupled to said one or more electrochemical deposition modules, and configured to supply at least one of said one or more electrochemical deposition modules with one or more metal constituents for depositing said one or more metals, said chemical management system including:

at least one metal enrichment cell that replenishes at least one of said one or more metal constituents and supplies said replenished metal constituent to at least one of said one or more electrochemical deposition modules in a synchronous manner with depositing said one or more metals on said substrate, and at least one metal-concentrate generator cell that generates a concentrated solution of at least one of said one or more metal constituents and doses at least one of said one or more electrochemical deposition modules with said concentrated metal constituent in an asynchronous manner or synchronous manner with depositing said one or more metals on said substrate.

2. The system of claim 1, wherein said chemical management system is located on said common platform proximate said one or more electrochemical deposition modules.

3. The system of claim 1, wherein said common platform is located on a fab floor, and said chemical management system is located on a sub-fab floor.

4. The system of claim 1, wherein said common platform comprises:

a wet area that includes said one or more electrochemical deposition modules; and a dry area coupled to said wet area, and configured to receive one or more substrates from a fab environment and transfer said one or more substrates into and out of said wet area.

5. The system of claim 1, wherein said at least one metal-concentrate generator cell generates said concentrated solution at a metal concentration that exceeds about 100 g/l.

6. The system of claim 1, wherein said metal enrichment cell replenishes said at least one of said one or more metal constituents at a metal concentration that is less than about 100 g/l.

7. The system of claim 1, wherein at least one of said one or more electrochemical deposition modules includes a soluble anode.

8. The system of claim 1, wherein at least one of said one or more electrochemical deposition modules includes an insoluble anode.

9. The system of claim 1, wherein at least one of said one or more electrochemical deposition modules includes an ion exchange membrane.

10. The system of claim 9, wherein said ion exchange membrane includes a cationic membrane or an anionic membrane.

11. The system of claim 1, wherein said at least one metal-concentrate generator cell comprises:

a metal-concentrate generator cell that defines an anode region, a cathode region, and a metal-ion capture region disposed between said anode region and said cathode region, said metal concentrate generator cell including a soluble anode disposed in said anode region, an inert cathode disposed in said cathode region, a first ion exchange membrane disposed between said anode region and said metal-ion capture region, and a second ion exchange membrane disposed between said cathode region and said metal-ion capture region;

a power source electrically coupled to said soluble anode and said inert cathode that generates metal-ions from said soluble anode when electrical current flows between said soluble anode and said inert cathode;

an anolyte reservoir and first pump that circulates said anolyte through said anode region of said metal-concentrate generator cell; and a metal-concentrate dispensing system coupled to an output of said first pump via a first valve, and arranged to supply doses of said metal-concentrate to at least one of said one or more electrochemical deposition modules.

12. The system of claim 1, wherein said at least one metal enrichment cell comprises:

an anode region and a cathode region, said metal enrichment cell including a soluble anode disposed in said anode region, an inert cathode disposed in said cathode region, and at least one ion exchange membrane disposed between said anode region and said cathode region;

a power source electrically coupled to said soluble anode and said inert cathode that generates metal-ions from said soluble anode when electrical current flows between said soluble anode and said inert cathode;

a catholyte reservoir and first pump that circulates said catholyte through said cathode region of said metal enrichment cell; and a metal enrichment circulation line and a second pump arranged to circulate a metal depleted process electrolyte from a process region of at least one of said one or more electrochemical deposition modules through said anode region of said metal enrichment cell, and supply a process electrolyte enriched by metal from said soluble anode to said process region of said at least one of said one or more electrochemical deposition modules.

13. The system of claim 1, wherein said at least one metal enrichment cell comprises:

an anode region, a cathode region, and a plating solution enrichment region disposed between said anode region and said cathode region, said metal enrichment cell including a soluble anode disposed in said anode region, an inert cathode disposed in said cathode region, a first ion exchange membrane disposed between said anode region and said plating solution enrichment region, and a second ion exchange membrane disposed between said cathode region and said plating solution enrichment region;

a power source electrically coupled to said soluble anode and said inert cathode that generates metal-ions from said soluble anode when electrical current flows between said soluble anode and said inert cathode;

an anolyte reservoir and first pump that circulates said anolyte through said anode region of said metal enrichment cell;

a catholyte reservoir and second pump that circulates said catholyte through said cathode region of said metal enrichment cell; and a metal enrichment circulation line and a third pump arranged to circulate a metal depleted process electrolyte from a process region of at least one of said one or more electrochemical deposition modules through said plating solution enrichment region of said metal enrichment cell, and supply a process electrolyte enriched by metal from said soluble anode to said process region of said at least one of said one or more electrochemical deposition modules.

14. The system of claim 13, wherein the metal enrichment cell comprises four chambers.

* * * * *